US007690739B2

(12) United States Patent
Brüstle et al.

(10) Patent No.: US 7,690,739 B2
(45) Date of Patent: Apr. 6, 2010

(54) DRAWER

(75) Inventors: Klaus Brüstle, Höchst (AT); Helmut Fitz, Lustenau (AT)

(73) Assignee: Julius Blum Gesellschaft m.b.H., Höchst (AT)

( * ) Notice: Subject to any disclaimer, the term of this patent is extended or adjusted under 35 U.S.C. 154(b) by 875 days.

(21) Appl. No.: 11/210,838

(22) Filed: Aug. 25, 2005

(65) Prior Publication Data

US 2005/0280340 A1 Dec. 22, 2005

Related U.S. Application Data

(63) Continuation of application No. PCT/AT2004/000102, filed on Mar. 19, 2004.

(30) Foreign Application Priority Data

Mar. 21, 2003 (AT) ..... A 458/2003

(51) Int. Cl.
*A47B 81/00* (2006.01)

(52) U.S. Cl. ..... 312/238; 312/348.4

(58) Field of Classification Search ..... 312/348.4, 312/238, 348.6, 326
See application file for complete search history.

(56) References Cited

U.S. PATENT DOCUMENTS

| | | | | | |
|---|---|---|---|---|---|
| 2,570,747 | A | * | 10/1951 | Bailey | 312/238 |
| 3,260,560 | A | * | 7/1966 | Hofstetter | 312/238 |
| RE32,816 | E | * | 1/1989 | Plank | 312/348.4 |
| 5,662,398 | A | | 9/1997 | Swallow | |
| 5,975,735 | A | * | 11/1999 | Schmitt | 700/2 |

FOREIGN PATENT DOCUMENTS

| | | | | |
|---|---|---|---|---|
| AT | 390 175 | B | 3/1990 | |
| DE | 3221073 | * | 12/1983 | 312/348.4 |
| DE | 90 14 366.3 | | 2/1991 | |
| DE | 42 41 612 | A1 | 6/1994 | |
| DE | 195 18 438 | A1 | 11/1998 | |
| DE | 200 09 986 | U1 | 10/2000 | |
| EP | 0 317 737 | A2 | 5/1989 | |
| EP | 451737 | * | 10/1991 | 312/238 |
| EP | 0 601 296 | | 10/1993 | |
| GB | 2 169 492 | A | 7/1986 | |
| JP | 2002-028039 | | 1/2002 | |
| NZ | 507687 | * | 9/2001 | |

OTHER PUBLICATIONS

Patent Abstracts of Japan, vol. 2002, No. 08, Aug. 5, 2002 & JP 2002 101984 A (Matsushita Electric Works Ltd; Nifco Inc), Apr. 9, 2002, abstract.

Patent Abstracts of Japan, vol. 2000, No. 23, Feb. 10, 2001 & JP 2001 149153 A (Hitachi Chem Co Ltd), Jun. 5, 2001, abstract.

* cited by examiner

*Primary Examiner*—Hanh V Tran
(74) *Attorney, Agent, or Firm*—Wenderoth, Lind & Ponack, L.L.P.

(57) ABSTRACT

A drawer (1) for a corner cabinet includes a front panel (4) angled inwards, two drawer side walls (2), a rear wall (5), and a drawer base (3). The front panel (4) has at least two plates (7'3") which, when the drawer (1) is extended from within the corner cabinet, move relative to the drawer side walls (2) at the beginning of the opening process and at the end of the closing process.

39 Claims, 38 Drawing Sheets

DRAWER

This application is a continuation of International Application No. PCT/AT2004/000102, filed Mar. 19, 2004.

BACKGROUND OF THE INVENTION

The invention relates to a drawer for a corner cabinet, with a front panel angled inwards, two drawer side walls, a rear wall and a drawer base.

The invention also relates to a corner front fitting for securing the plates of a front panel, which is angled inwards, to a drawer.

In the case of kitchen cabinets which enclose a corner, it is generally usual to provide a circular storage element in this corner. The spatial utilisation of this circular storage element is not very satisfactory, as a result of which there is now a tendency for corner cabinets also to be equipped with drawers. A problem which arises with such corner cabinets is that the panels of adjacent drawers get in the way of the panels of the corner drawers and hinder the opening of the corner drawer. One possibility of resolving this problem is to provide a greater distance interval between the corner drawers and the adjacent drawers. This, however, leads to the formation of unattractive joints.

It is therefore an object of the invention to create a corner drawer wherein the front panel terminates in final contact with the panels of adjacent drawers without the extending of the corner drawer being impeded.

SUMMARY OF THE INVENTION

The object of the invention is resolved in that the front panel comprises at least two plates which, when the drawer is extended from within the corner cabinet, move relative to the drawer side walls at the beginning of the opening process and at the end of the closing process.

A preferred embodiment is made for the plates to move relative to each other when the drawer is opened.

In order for the plates to be able to move more easily relative to the drawer when the drawer is being opened, preferably an interlocking device is provided, which holds the drawer locked in the body of the furniture while the plates are moved relative to the drawer side walls.

Provision is further made to advantage for the plates to move relative to one another when the drawer is opened, wherein the lateral outer edges of the plates, with a component transverse to the extraction direction of the drawer, move towards the middle of the drawer.

One embodiment of the invention provides that at least one of the plates is acted upon by a force accumulator, which pushes the moved plate into a rest-position. Accordingly the plates will be automatically brought into their initial position, i.e. their mounting position, after the drawer is closed.

The force accumulator preferably comprises a spring.

A further embodiment of the invention provides that two plates are pivotably mounted to the drawer.

A further embodiment of the invention provides that one plate is pivotably mounted to the drawer, and another plate is linearly displaceable in its mounting plane.

A further preferred embodiment of the invention provides that one plate, perpendicular to its mounting plane, to be mounted so as to be displaceable relative to the drawer, and for another plate to be linearly displaceable in its mounting plane.

The corner front fitting according to the invention is characterised by a carrier part angled inwards, with retaining devices for securing the carrier part to a drawer, wherein two retaining parts for the plates of the front panel, movable relative to the carrier part, are mounted on the carrier part, by means of which the plates can be moved between a first position, which corresponds to the closed drawer, and a second position, which allows the drawer to be extended from within the body of the furniture element.

A further embodiment of a corner front fitting according to the invention preferably comprises two retaining parts for the plates, in each case capable of being tilted about a vertical axle, and a control part which can be secured to the body of the furniture element, with two guide tracks, in each of which one end of a retaining part is guided when the drawer is opened and closed.

BRIEF DESCRIPTION OF THE DRAWINGS

A number of different embodiments of the invention are described hereinafter on the basis of the Figures in the appended drawings. These show.

DETAILED DESCRIPTION OF PREFERRED EMBODIMENTS

Figure 1:
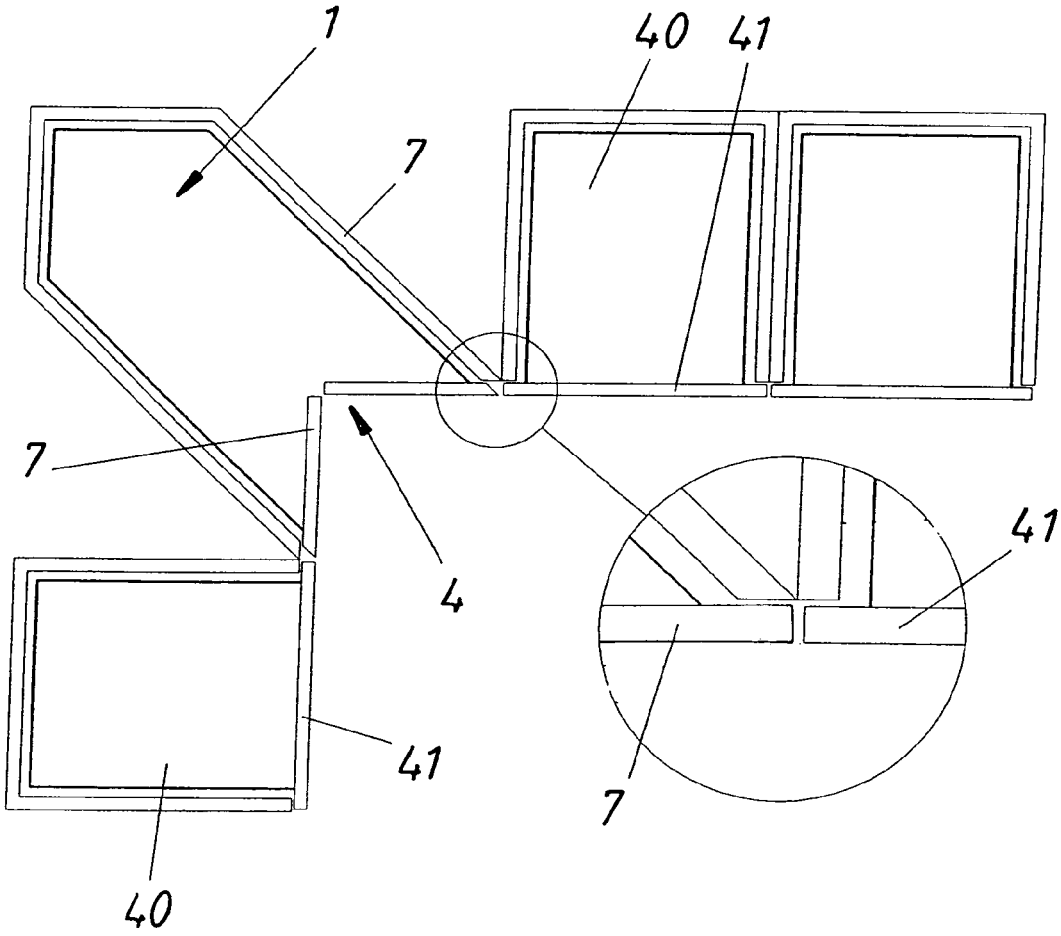
FIG. 1 A top plan view of a kitchen cabinet with drawers according to the invention, FIG. 2 A. view of a corner cabinet with drawers according to the invention, FIG. 3 A view of a drawer according to the invention, FIG. 4 A top plan view of the front panel area of a drawer according to the invention with the drawer closed, FIG. 5 A top plan view of the front panel area of a drawer according to the invention, whereby the plates have been moved out of the mounting position, FIG. 6 A top plan view of the front panel area of a drawer according to the invention during the drawing out or sliding in of the drawer, FIGS. 7 to 9 Plan views analogous to FIGS. 4 to 6, whereby a further embodiment of the invention is shown, FIGS. 10 to 12 Views analogous to FIGS. 4 to 6, whereby a further embodiment of the invention is shown, FIGS. 13 to 15 Views analogous to FIGS. 4 to 6, wherein a further embodiment of the invention is shown, FIG. 16 Illustration of the arrangement of a corner cabinet with corner drawers drawn out, FIG. 17 Illustration of the arrangement of a corner cabinet with drawers slid into the body of the furniture element, FIG. 18 A top plan view of a corner drawer partly extended from within the body of the furniture element, FIG. 19 A top plan view of a corner drawer fully slid into the body of the furniture element, FIG. 20 An exploded view of a corner drawer, FIG. 21 An illustration of a corner drawer, FIG. 22 An illustration of a drawer base and drawer side walls, FIG. 23 An illustration of a drawer base and drawer side walls with the corner front fitting being installed, FIG. 24 An illustration of a drawer base and the drawer side walls with the corner front fitting being installed, FIG. 25 An illustration of a drawer base and the drawer side walls with the cover front fitting installed and a plate of a front panel fitted, FIGS. 26 to 27 In each case, an illustration of a drawer with corner front fitting and front panel installed, FIG. 28 A top plan view of a drawer at the beginning of the opening movement or at the end of the closing movement, FIG. 29 A top plan view of a drawer according to the invention, wherein the drawer is shown in the fully retracted position, FIG. 30 A top plan view of the body of a furniture element and the front corner fitting with the drawer slightly extended from within the furniture element body, FIG. 31 The section A from FIG. 30, FIG. 32 A top plan view of a furniture element body with a corner drawer fully retracted, FIG. 33 The section A from FIG. 32, FIG. 34 A top plan view of a furniture element body and the front panel of a cover drawer at the beginning of the opening movement, FIG. 35 The section A from FIG. 34, FIG. 36 A top plan view of a corner cabinet and the front panel of a corner drawer, during the opening of the corner drawer, FIG. 37 The section A from FIG. 36, FIG. 38 The section A from FIG. 36, wherein the opening movement is further advanced, FIG. 39 A top plan view of a side of a corner front fitting according to a further embodiment of the invention, FIG. 40 A view of such a corner front fitting, FIG. 41 An exploded view of a corner front fitting, FIG. 42 An exploded view of a corner front fitting, wherein the corner front fitting is rotated through 90° in relation to FIG. 41, FIG. 43 A horizontal section through one end of a corner front fitting, FIG. 44 A horizontal section through one end of a corner front fitting with the retaining part pivoted out, FIG. 45 A view of one end of a corner front fitting, FIG. 46 A further view of one end of a corner front fitting, FIG. 47 A view of the middle area of the corner front fitting with retaining parts pivoted out, FIG. 48 A horizontal section through the middle area of the corner front fitting with retaining parts pivoted out, FIG. 49 A view of the middle area of a corner front fitting, wherein the retaining parts are shown with the drawer in the slid-in position, FIG. 50 A horizontal section through the middle area of a corner front fitting, wherein the retaining parts are shown with the drawer in the slid-in position, FIG. 51 A top plan view of the panel area of a corner drawer and a further embodiment of a corner front fitting, FIG. 52 The section A from FIG. 52, FIG. 53 A top plan view of the panel area of a drawer according to FIG. 52, wherein the front panel is shown during its opening movement, FIG. 54 The section A from FIG. 56, FIG. 55 A top plan view of the panel area of a drawer, wherein the drawer is in a pulled-out position, FIG. 56 The section A from FIG. 55, FIG. 57 A top plan view of the panel area of a drawer with the drawer fully retracted into the body of the furniture element, FIG. 58 A top plan view of a corner front fitting before the mounting of a plate, FIG. 59 A top plan view of a corner front fitting during the mounting of a plate, FIG. 60 A top plan view of a front corner fitting with a plate mounted, FIG. 61 A section of a corner front fitting with a plate mounted, FIG. 62 A face view of a front corner fitting and a plate, FIGS. 63 to 67 Top plan views of a corner front fitting with a plate mounted, wherein the adjustment of the plate position is shown, FIGS. 68 to 69 Sections of the corner front fitting and of a plate, wherein the possibility of adjusting the plate in the height of the drawer is shown, FIG. 70 A view of a retaining device according to the invention, FIG. 71 A longitudinal section through a retaining device according to the invention, wherein the retaining arm is shown before mounting on the mounting plate, FIG. 72 A longitudinal section through the retaining device according to the invention, wherein the retaining arm is shown during mounting on the mounting plate, FIG. 73 A longitudinal section through the retaining device according to the invention, wherein the retaining arm is shown mounted on the mounting plate.
Figure 2:
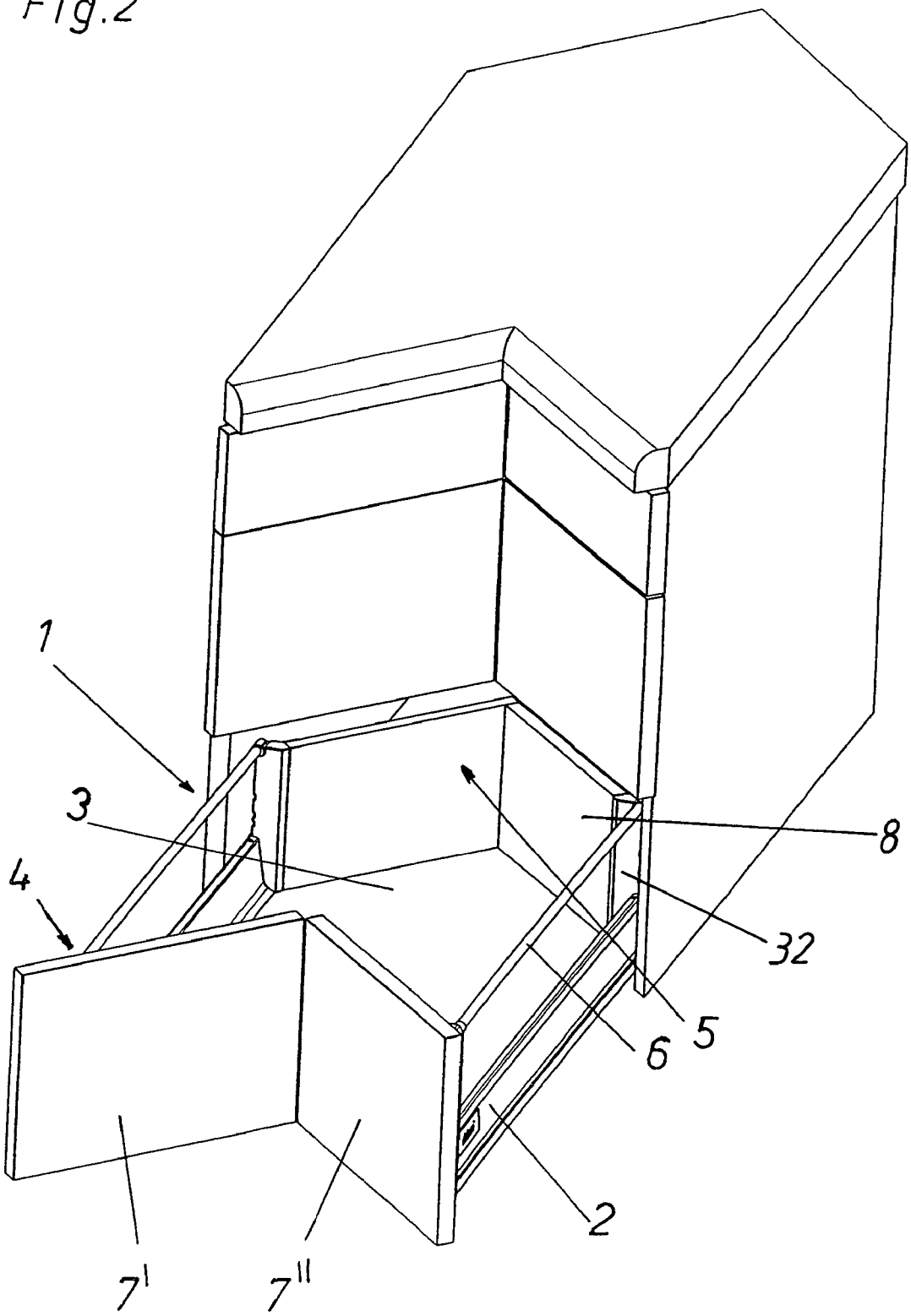
Figure 3:
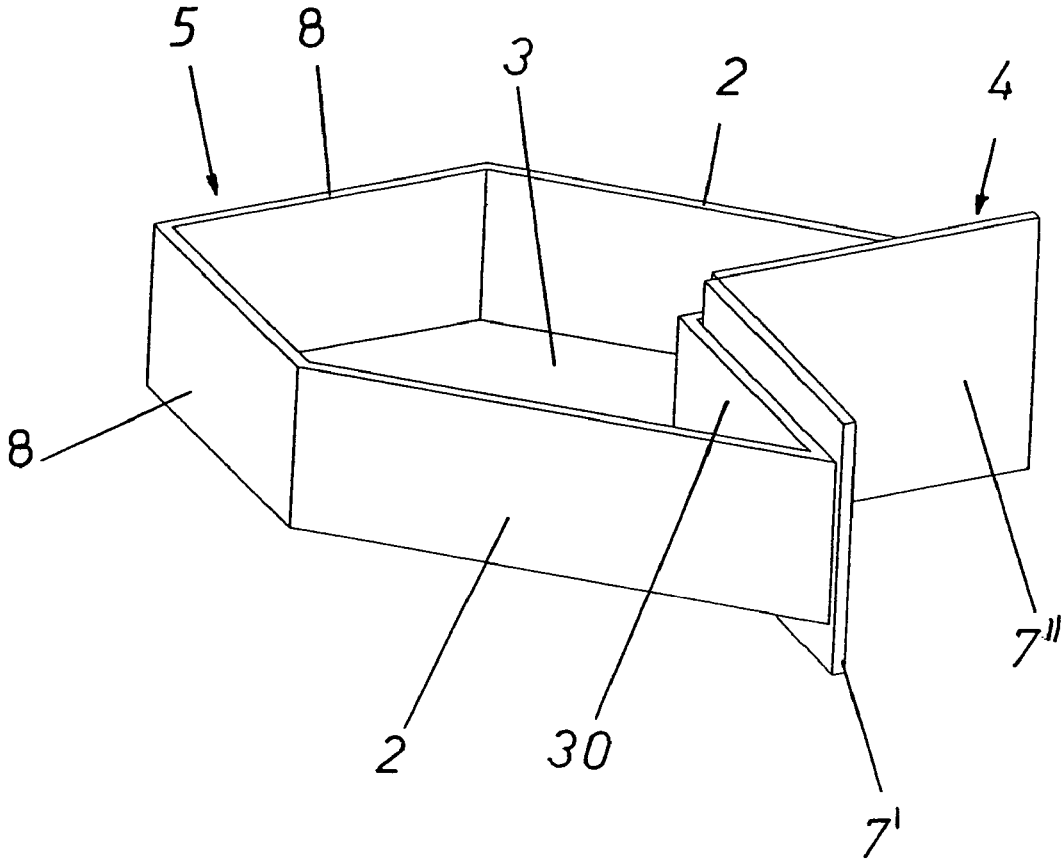

The drawer 1 according to the invention is provided in the conventional manner with drawer side walls 2 and a drawer base 3. The front panel 4 of the drawer 1 is angled inward and the rear wall 5 of the drawer is angled outward. The front panel 4 is therefore adapted to the corner in the room and, thanks to the angled drawer rear wall 5, a better utilisation of the space is obtained.

A railing 6 may be provided which runs above the drawer side walls 2.

The front panel 4 comprises two plates 7 standing at right angles to each other, and the drawer rear wall 5 is formed from two plates 8, which are likewise at right angles to each other. Located behind the plates 7', 7", a closure wall 30 is arranged.

FIG. 1 shows the arrangement of the drawer according to the invention in a kitchen cabinet 4. According to the invention, conventional drawers 40 are located on both sides of the drawer 1, and have front panels 41, at which the plates 7', 7" of the drawer 1 are delimited. With the drawer closed, the plates 7', 7" are in the closure position shown in FIG. 1.

In order to avoid the plates 7', 7" of the front panel 4 striking against the front panels 41 of the adjacent drawers 40 when the drawer 1 is opened, the plates 7', 7" are mounted on the drawer 1 so as to be movable relative to the drawer side walls 2 and relative to one another. During the opening process, first the plates 7', 7" are moved in such a way that they can be moved with their lateral outer faces 14 past the adjacent front panels 41. This is the opening position of the plates 7', 7". While the drawer 1 is being moved, the plates 7', 7" remain in this opening position. Only when the drawer 1 is again completely slid into the body of the furniture element, the plates 7', 7" are again moved apart into their closure position, in which they are delimited by narrow joints from the adjacent front panels 41.

Figure 4:
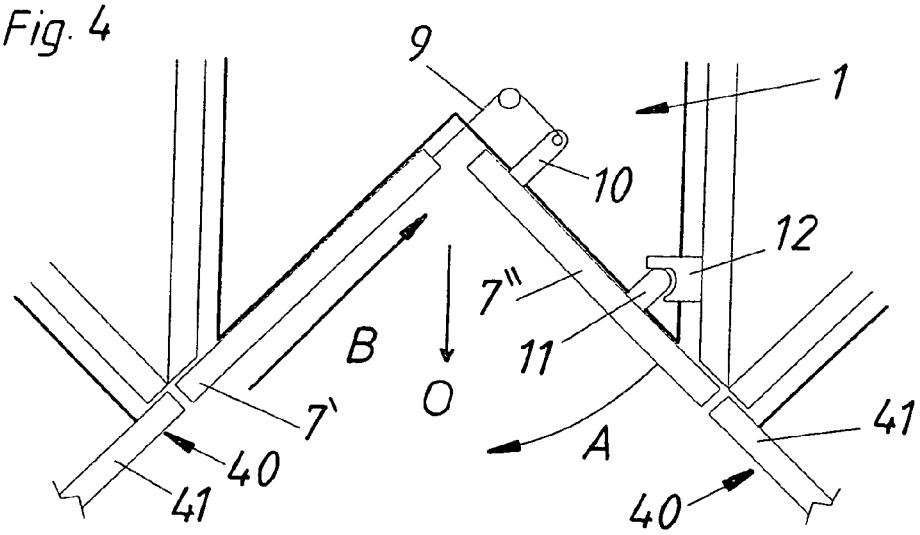
Figure 5:
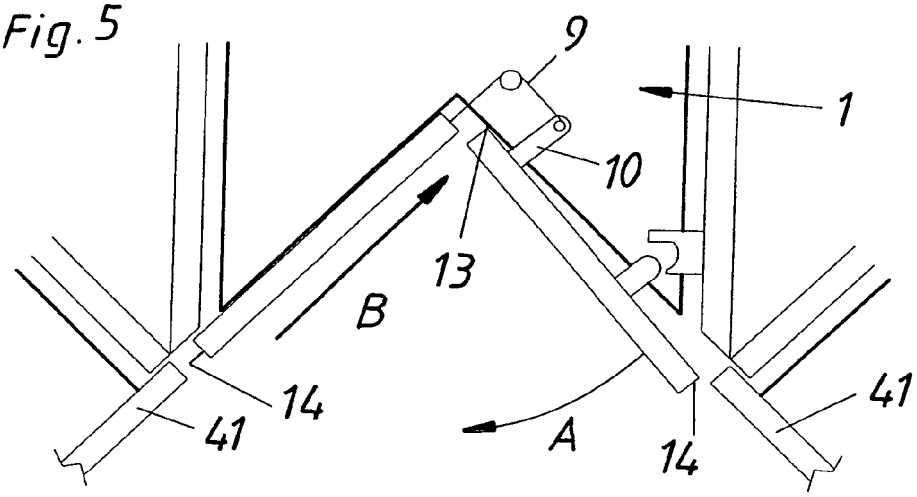
Figure 6:
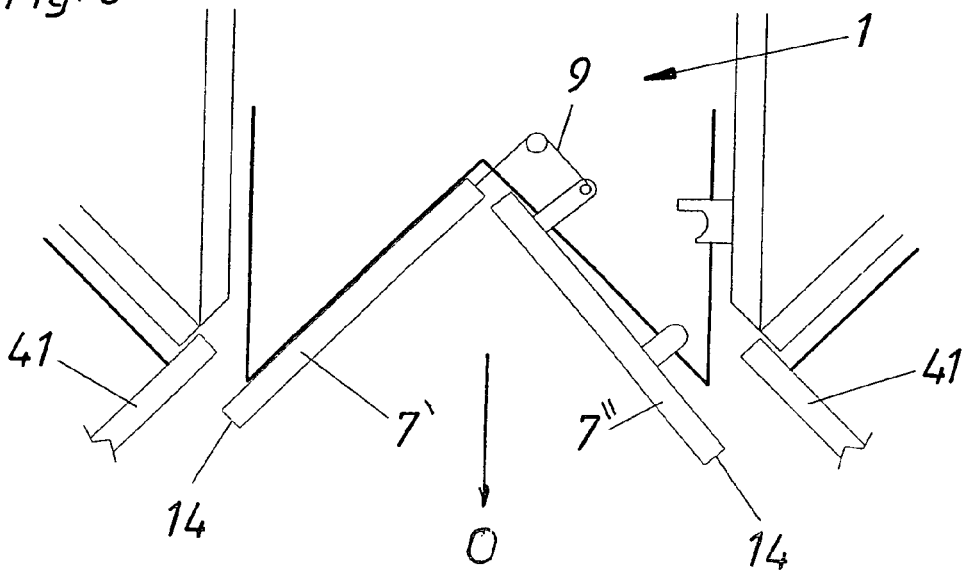

In the embodiment according to FIGS. 4 to 6, the first plate 7' is arranged horizontally on the drawer 1 and is capable of being moved in linear fashion. The second plate 7" is mounted on the drawer 1 so as to be pivotable. Both plates 7', 7" are connected to one another by at least one cable of a drawing cable 9. The plate 7" is provided with a pin 10, to which the drawing cable 9 is secured. The plate 7" also comprises a retaining element 11, which, with the drawer 1 in the closed position, engages a corresponding retaining part 12, which is secured to the side wall of the body of the furniture element.

As can be seen from. FIG. 4, which shows the closed position of the plates 7', 7", the lateral outer edges 14 of the plates 7', 7" lie close to the outer edges of the adjacent front panels 41. If the plates 7', 7" were to remain in the position shown in FIG. 4 when the drawer 1 was drawn out, they would strike against the front panels 41 of the adjacent drawers 40.

In order to avoid this, the plates 7', 7" are mounted on the drawer 1 so as to be movable.

The second plate 7" can be pivoted about an axle 13. If the second plate 7" is pivoted about the axle 13, as shown in FIG. 5, in the direction of the arrow A, the plate 7" is moved in a linear fashion in the direction of the arrow B in FIG. 5. The plates 7', 7" are therefore located in their open position. The lateral outer edges 14 of the plates 7', 7" can therefore be moved past the adjacent front panels 41.

The first plate 7' in this case is preferably acted upon by a force accumulator, which is preferably a spring, which moves the first plate 7' against the direction of the arrow B. If the drawer 1 is closed and slid fully into the body of the furniture element, both plates 7', 7" are again brought into the closed position shown in FIG. 4, in that the first plate 7' is displaced in a linear fashion against the direction of the arrow B and the second plate 7" is pivoted against the direction of the arrow A.

Figure 7:
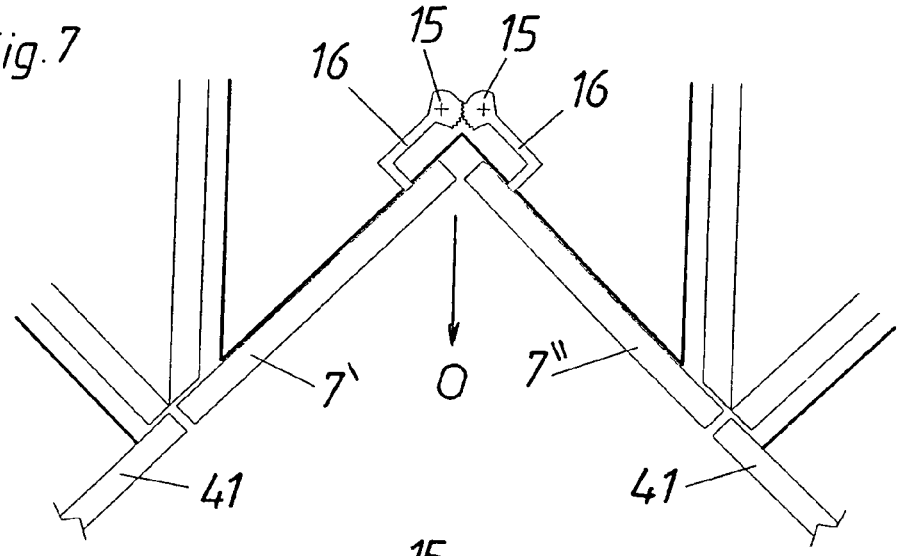
Figure 8:
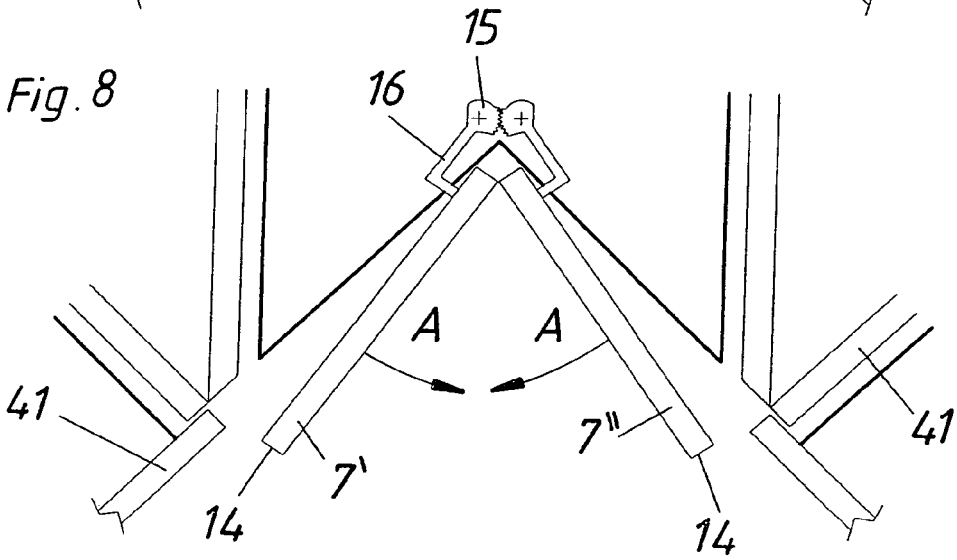
Figure 9:
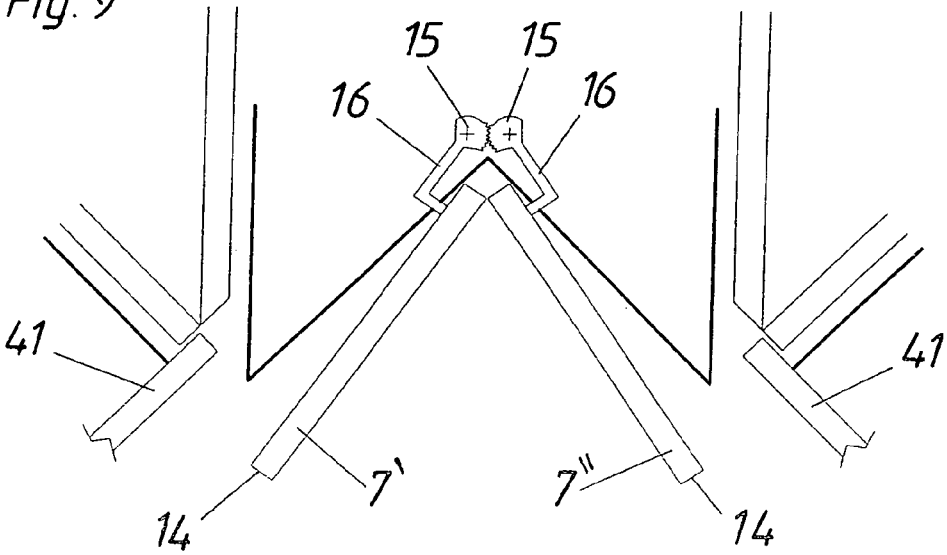

In the embodiment according to FIGS. 7 to 9, both plates 7', 7" are provided with arms 16, at the free ends of which toothed wheel sections 15 are formed, which mesh with one another. Both plates 7', 7" are mounted at the drawer 1 so as to pivotable. FIG. 7 shows the closed position of the plates 7', 7" and FIGS. 8 and 9 show the open position.

If one of the plates 7', 7" is pivoted in the direction of one of the arrows A in FIG. 8, an equally great pivoting movement occurs in the other of plates 7', 7" in the opposite direction. The plates 7', 7" are, in a manner of speaking, folded together. Also in this case, the lateral outer edges 14 of the plates 7', 7" are pivoted inwards far enough that the drawer 1 can be opened without the lateral outer edges 14 of the plates 7', 7" striking the outer edges of the adjacent front panels 41. The plates 7', 7" can be coupled to a force accumulator, which, after the drawer has been closed, again moves the plates 7', 7" into the closed position shown in FIG. 7. It is, however, also sufficient for one of the plates 7', 7" to be pushed manually into the closed position, whereby the other of plates 7', 7" is likewise moved into the closed position by the toothed wheel segments 15.

Figure 10:
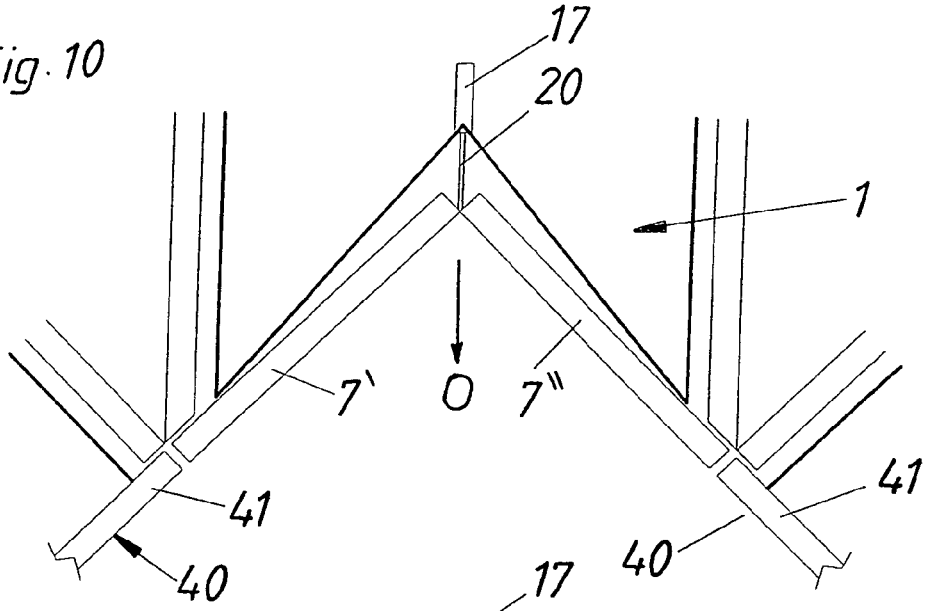
Figure 11:
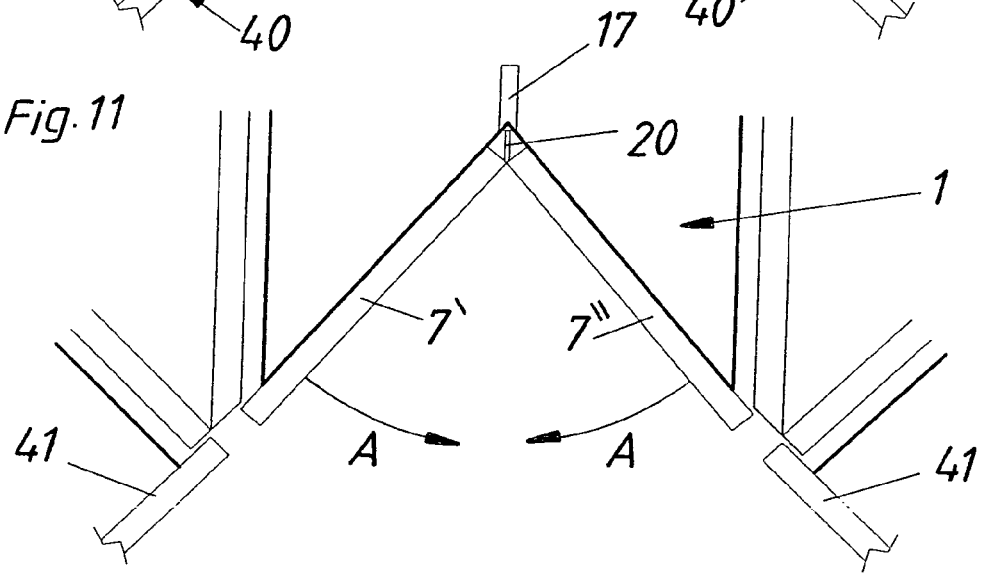
Figure 12:
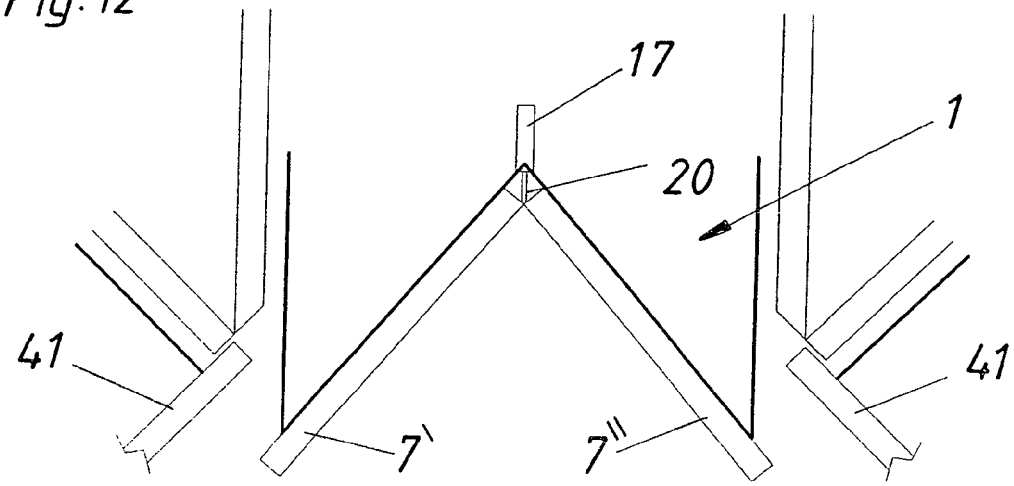

In the embodiment according to FIGS. 10 to 12, the plates 7', 7" are connected to a common pusher element 20. The pusher element 20 comprises, for example, a piston rod, and the piston of the pusher element 20 can be linearly displaced in a cylinder 17.

If, before the beginning of the opening movement of the drawer 1, one of the plates 7', 7" is pivoted inwards in the direction of the arrows A, the pusher element 20 moves to the rear and the other of plates 7', 7" is pivoted in the opposite direction of the first plate 7', 7", The lateral outer edges 14 of the two plates 7°, 7" can therefore be moved past the adjacent front panels 41.

Figure 13:
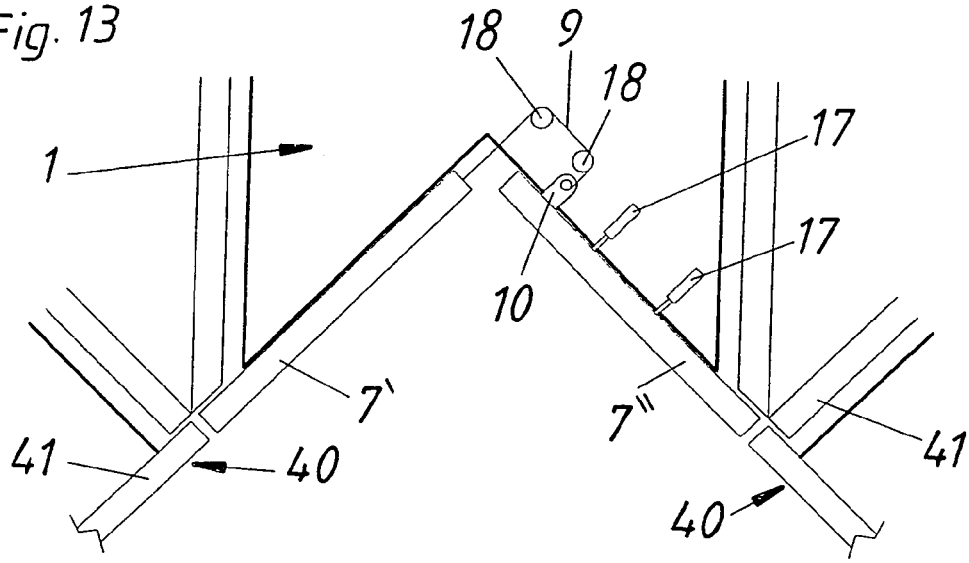
Figure 14:
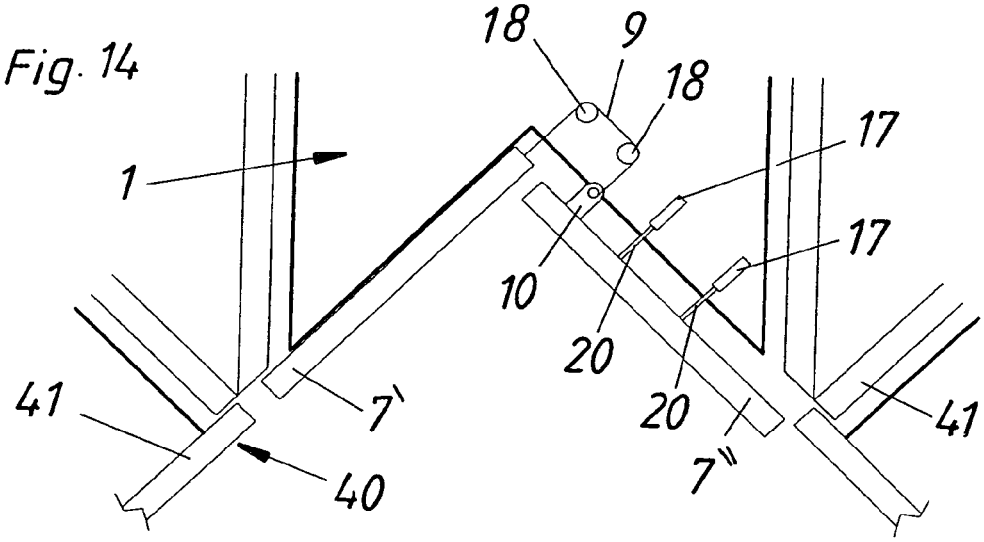
Figure 15:
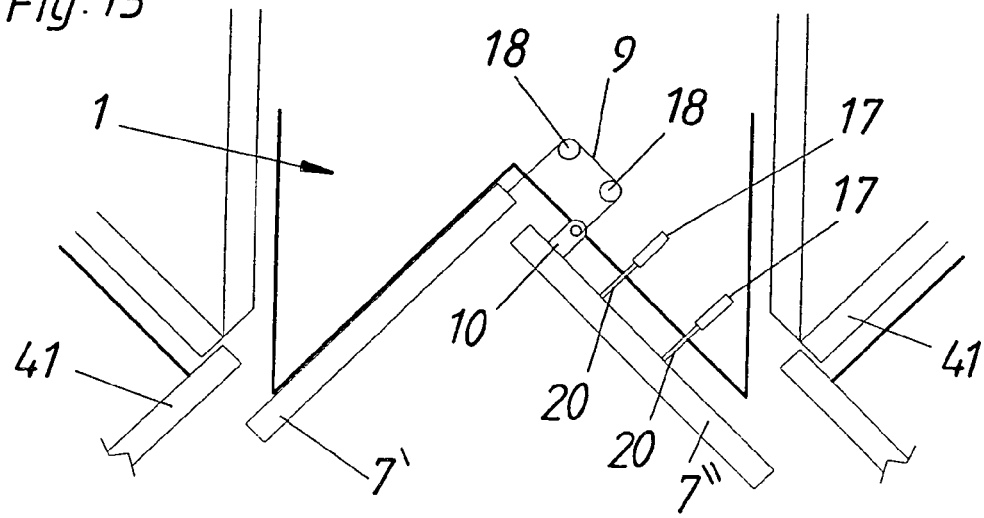

In the embodiment according to FIGS. 13 to 15, the second plate 7" is mounted so as to be linearly displaceable by means of two pusher elements 20 on the drawer 1. The direction of movement of the second plate 7" runs perpendicular to the mounting plane of the first plate 7'. The first plate 7' is capable of being moved in its mounting plane perpendicular to the second plate 7" in a linear fashion.

The two plates 7', 7" are again connected to each other by at least one cable of a drawing cable 9. The second plate 7" comprises at least one pin 10, to which the cable 9 is secured. Deflection rollers 18 are also provided, which serve to guide the cable.

If the second plate 7" is raised from the drawer 1, the first plate 7', as indicated, is being moved. The lateral outer edges 14 of the plates 7', 7" are moved into a free position in relation to the adjacent front panels 41. FIGS. 10 and 13 again show the closed position of the plates 7', 7", and FIGS. 12 and 15 show the open position.

The first plate 7' is in turn coupled to a force accumulator, such as a spring, which in turn moves the first plate 7' and therefore the second plate 7" into the closed position when the drawer is closed.

In all cases, when the drawer 1 is opened, the lateral outer edges 14 of the plates 7', 7" are moved with a component transverse to the drawing out direction 0 of the drawer 1, towards the middle of the drawer 1. It is also possible for the drawer 1 to be pushed a short distance into the body of the furniture element during the opening process, while the plates 7', 7" are moved relative to the drawer side walls 2.

The drawer rear wall 5 consists of two plates 8 standing at right angles to one another, which are, for example, screwed or glued to each other. There is also the possibility of the plates 8 being connected to one another by means of a suitable fitting.

Provision is made for retaining parts 32, by means of which the plates 8 are secured to the drawer side walls 3. The retaining parts 32 also serve to provide the rear anchoring of the railing 6.

Figure 16:
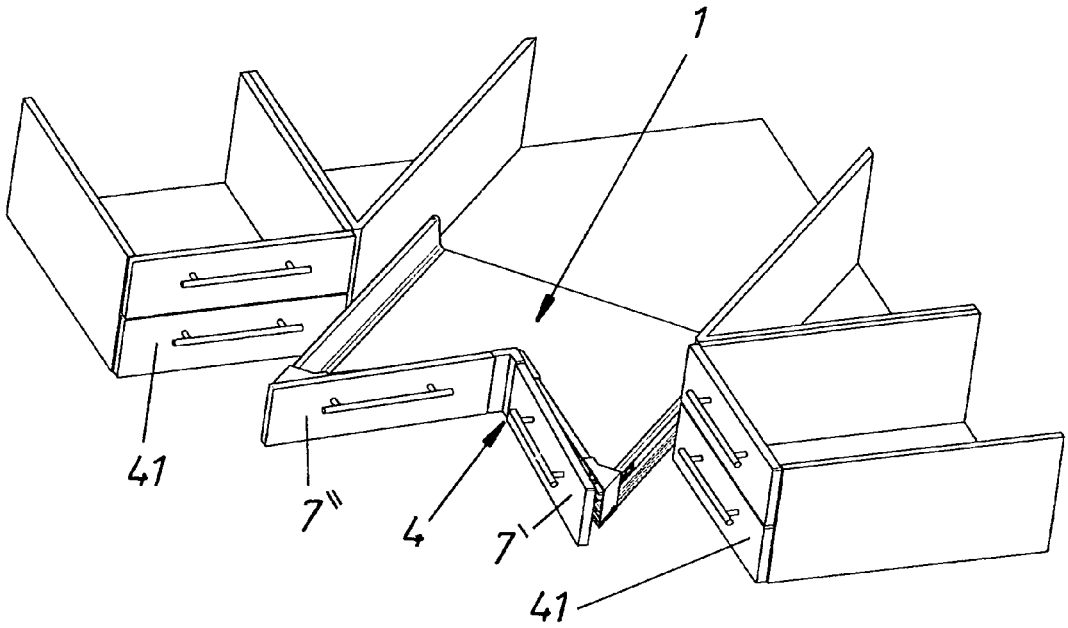
Figure 17:
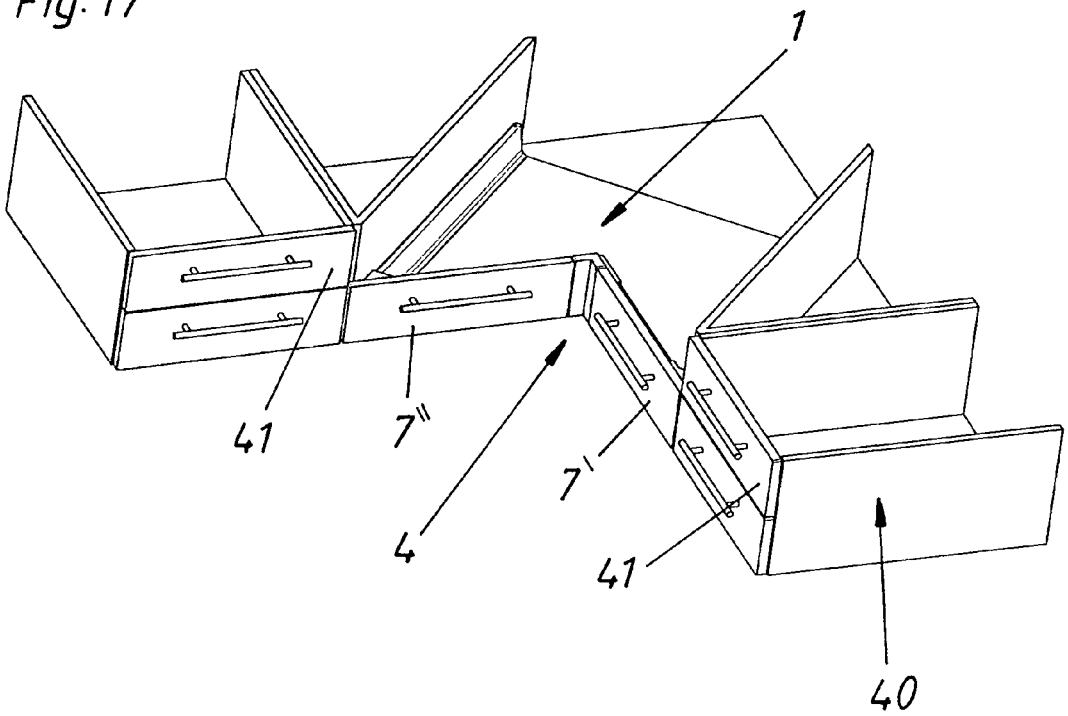
Figure 18:
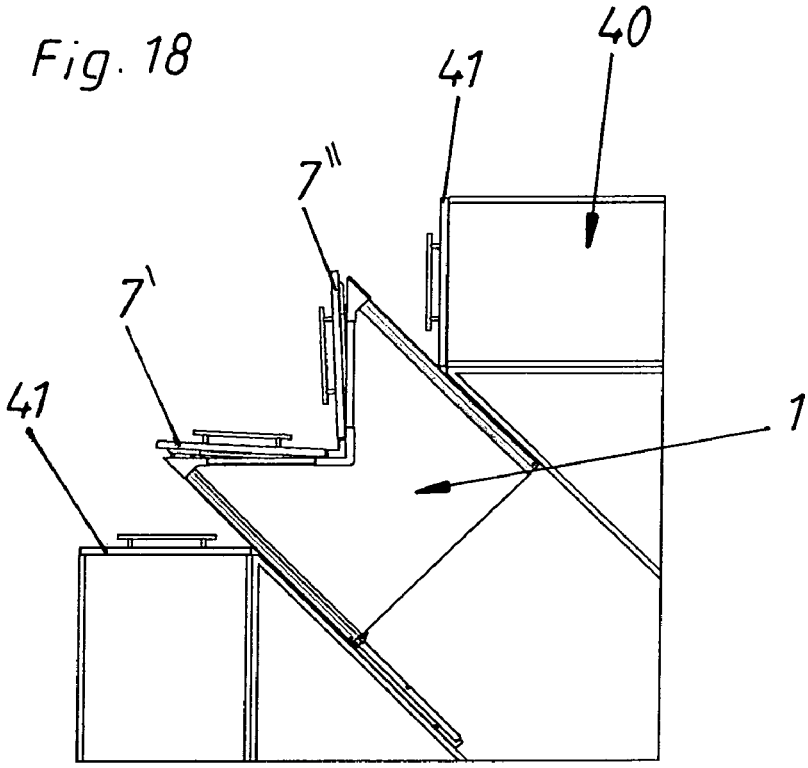
Figure 19:
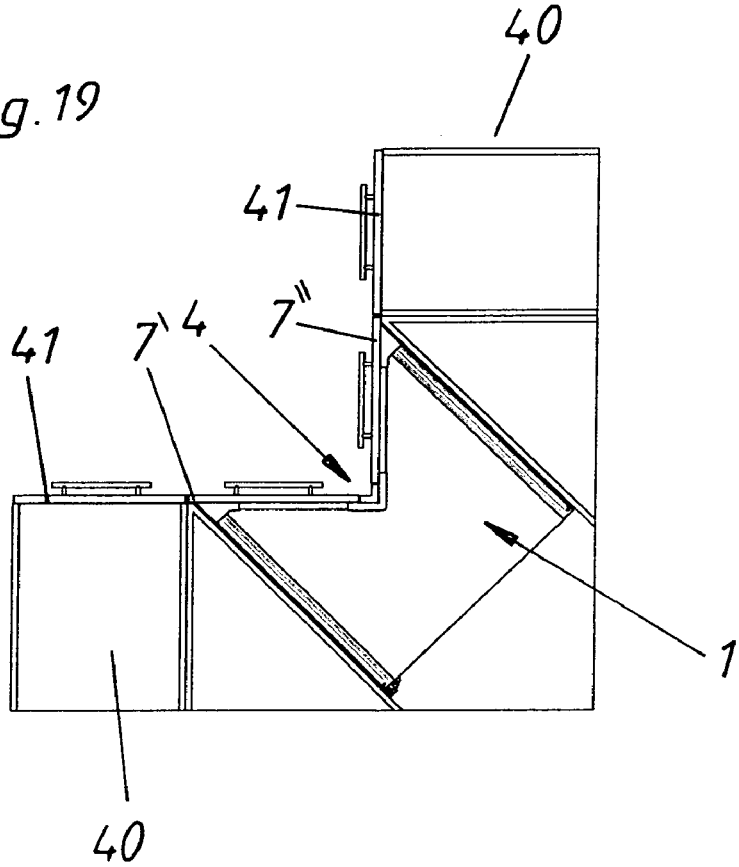

FIGS. 16 to 19 show the installation of a corner cabinet, for example of a kitchen. In FIGS. 16 and 18 the drawer 1 is shown extended from the body of the furniture element and in FIGS. 17 and 19 the drawer 1 is shown in the fully slid-in position.

Figure 20:
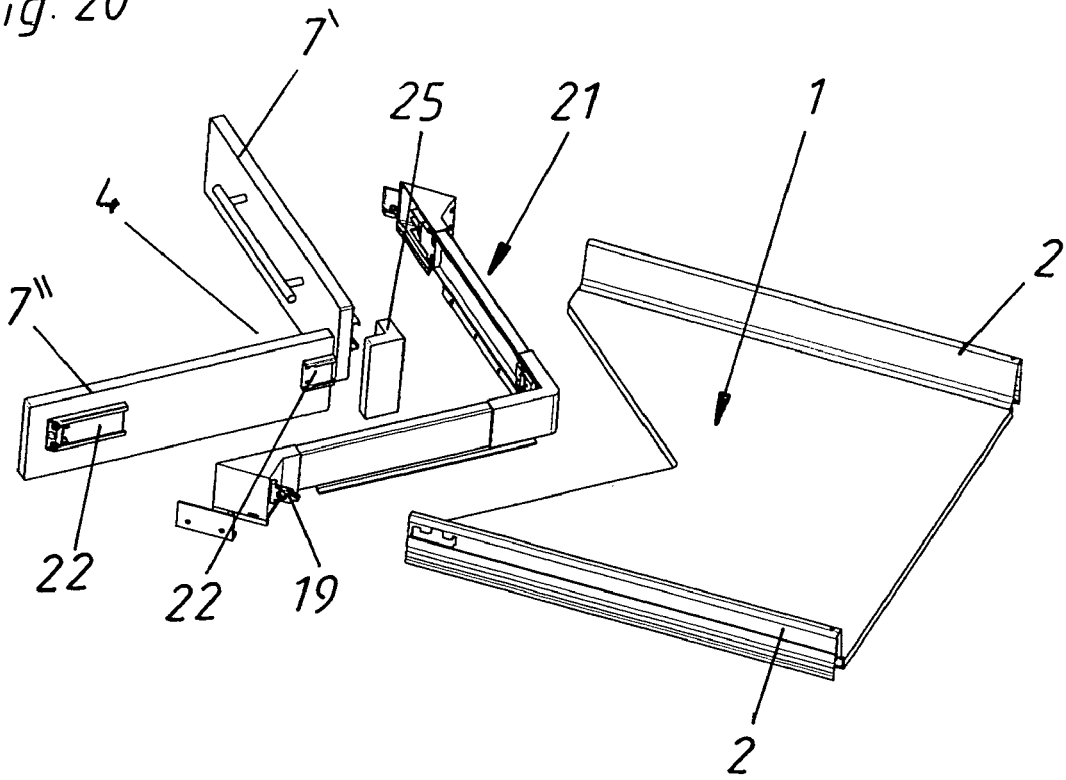
Figure 21:
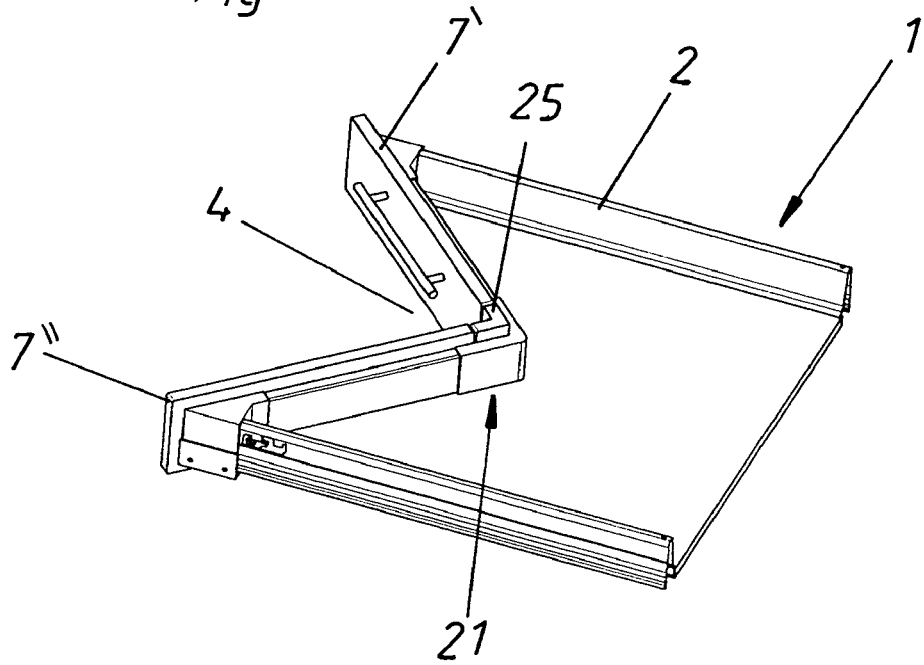
Figure 22:
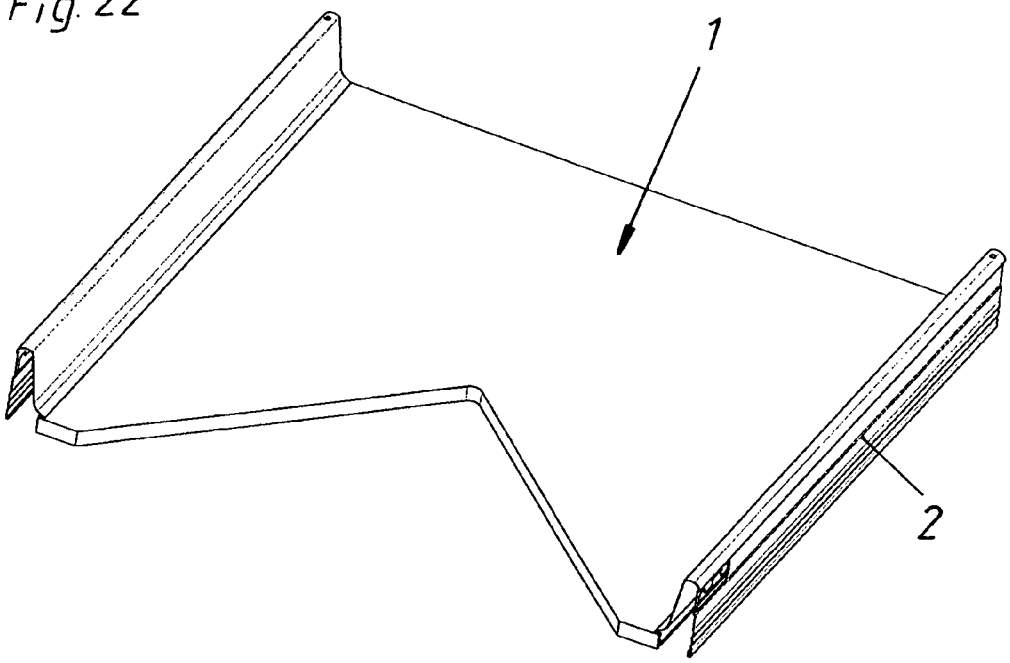
Figure 23:
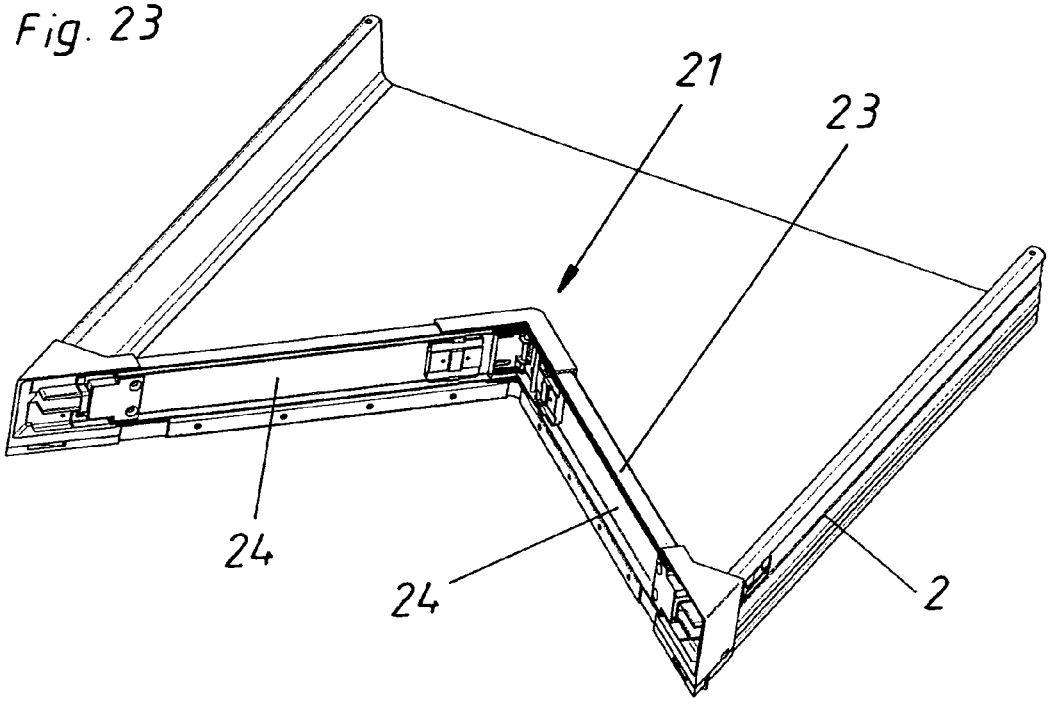

FIG. 20 shows an exploded illustration of a drawer 1, which is fitted with a corner front fitting 21 according to the invention for securing the front panel 4. The corner front fitting 21 can be coupled in a conventional manner by means of retaining parts 19 to front panel retaining elements arranged in the drawer side walls 2. A suitable front panel retaining element is described, for example, in EP 0 636 327 B1 by the Applicant.

Figure 24:
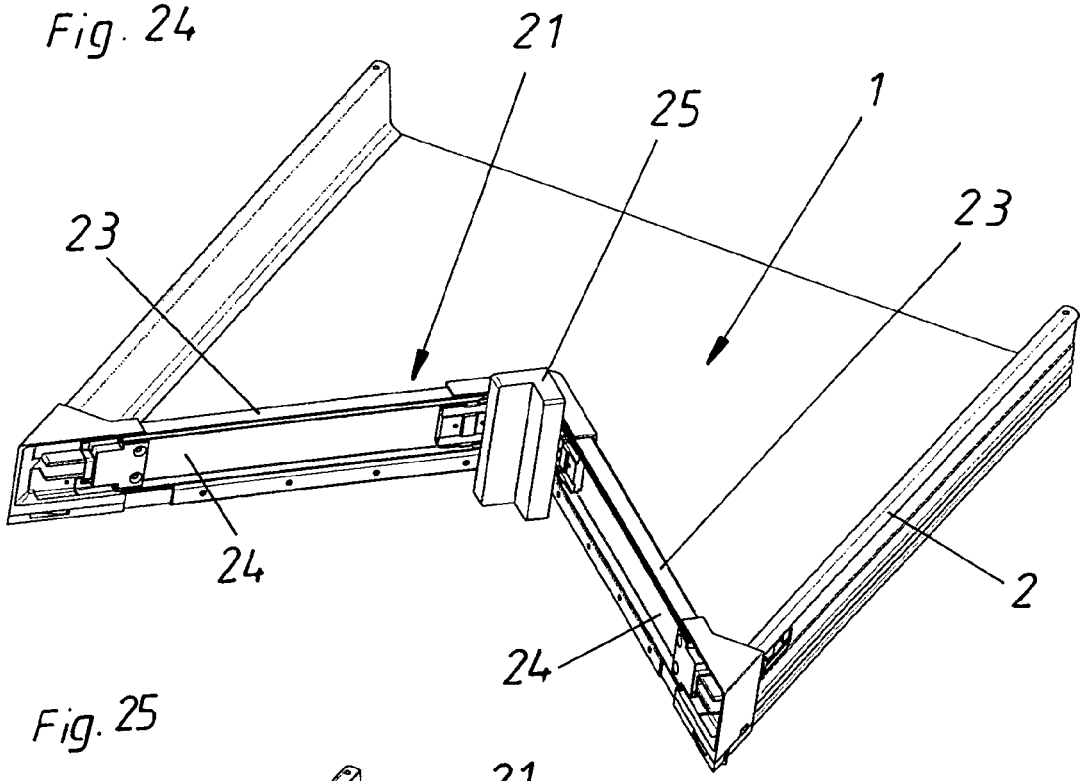
Figure 25:
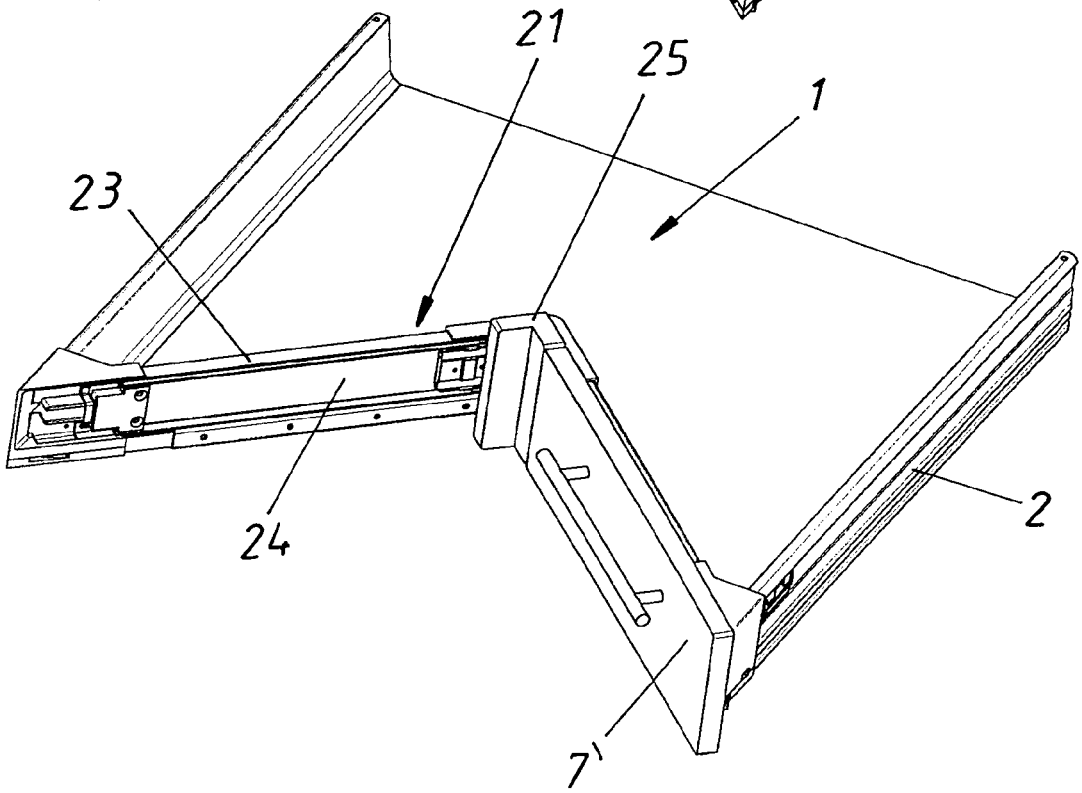
Figure 26:
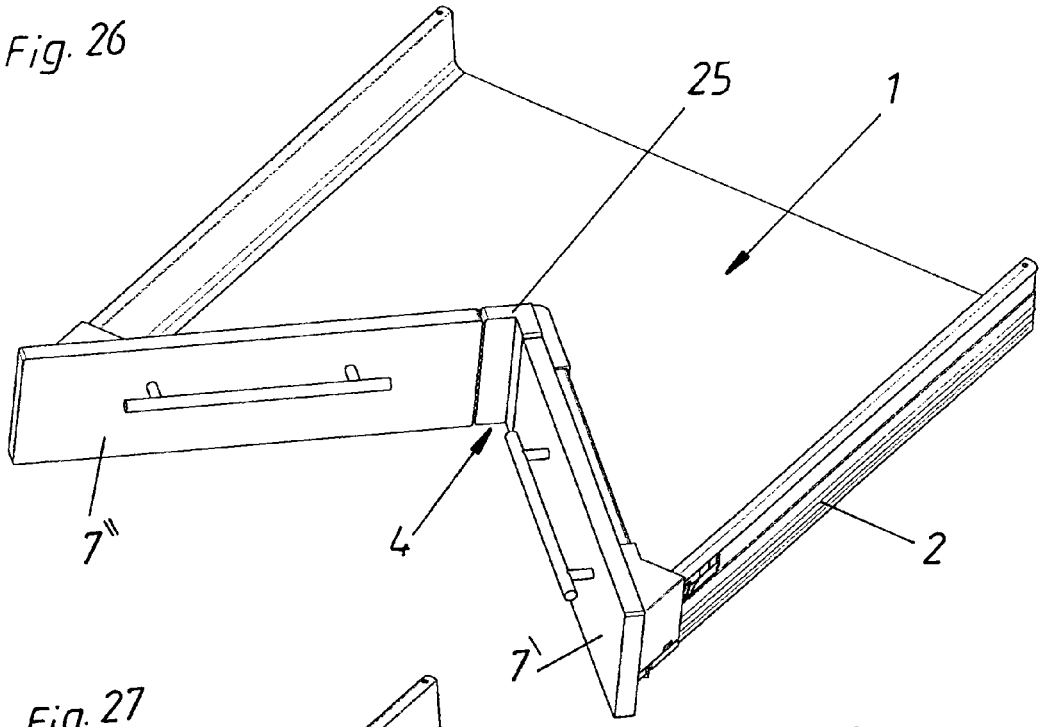
Figure 27:
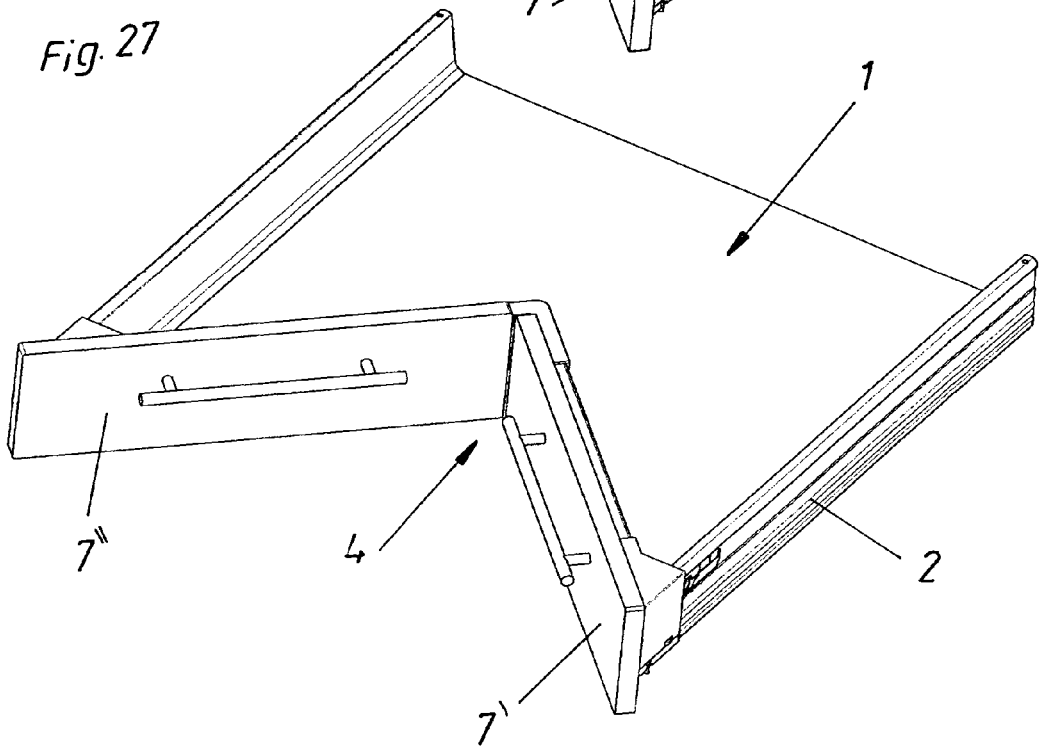

Fitting parts 22 are mounted on the plates 7', 7" of the front panel 4, by means of which the plates 7', 7" can be anchored to the corner front fitting 21. The corner front fitting 21 comprises a carrier part 23, angled inwards, which can be directly mounted to the drawer 1 by means of the retaining devices 19, and retaining parts 24, mounted so as to pivot on the carrier part 23, which directly carries the plates 7', 7". In the embodiment according to FIGS. 24 to 26 a middle post 25 is provided between the plates 7', 7". This middle post 25 can be done away, however, but then a vertical joint is visible between the two plates 7',7".

Figure 28:
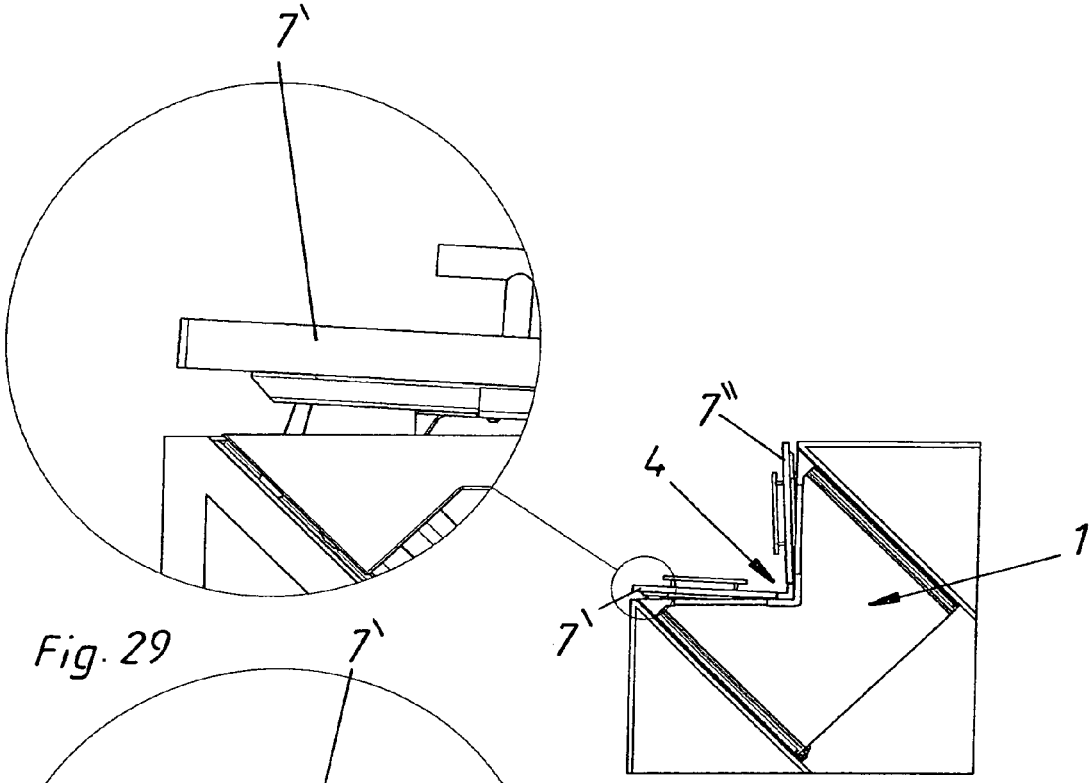
Figure 29:
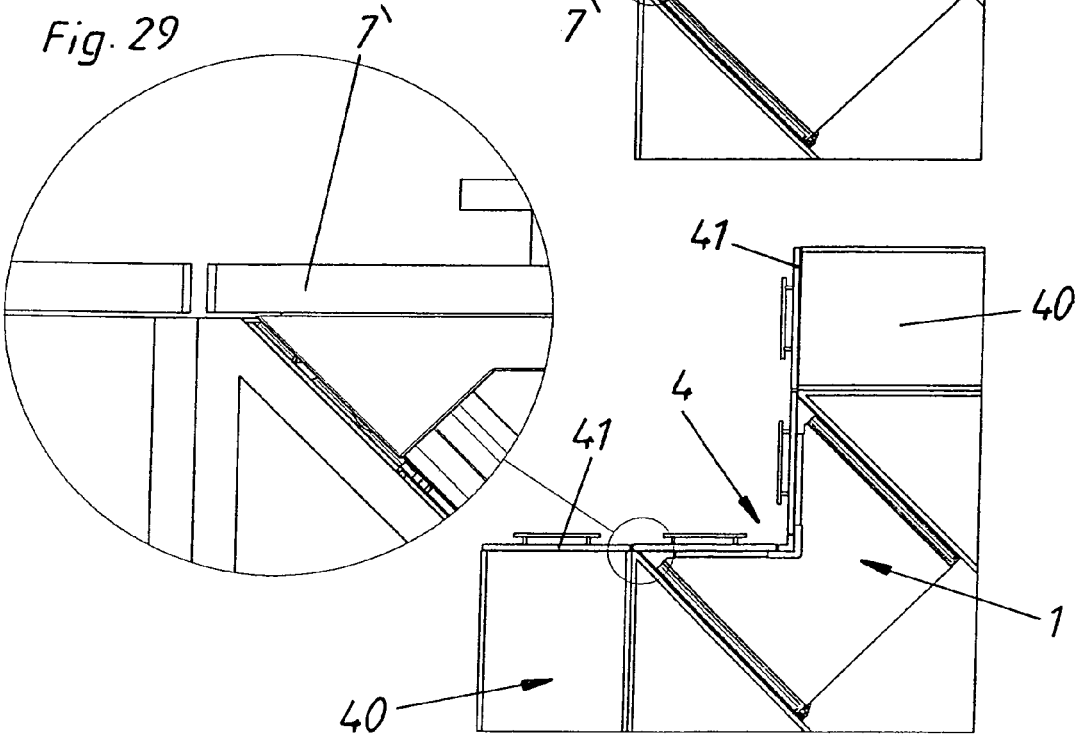
Figure 31:
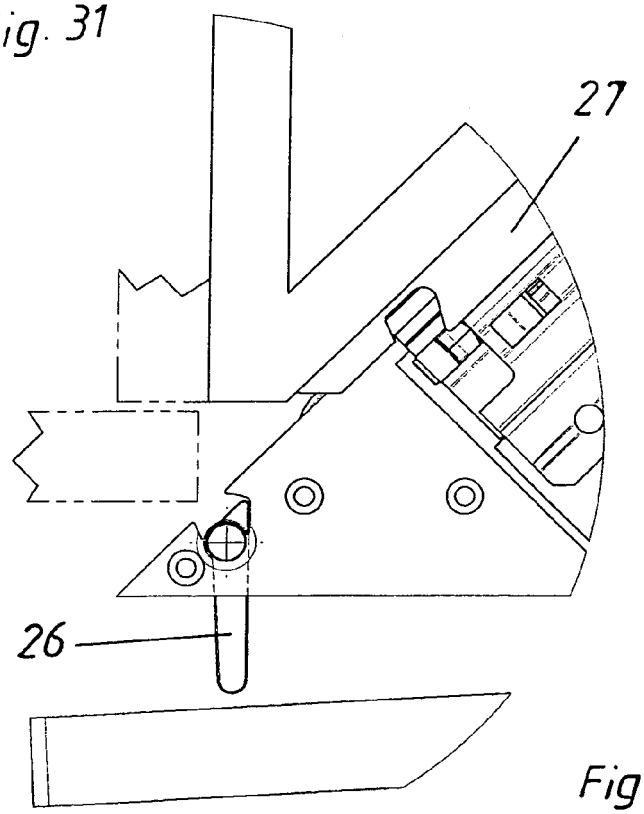
Figure 30:
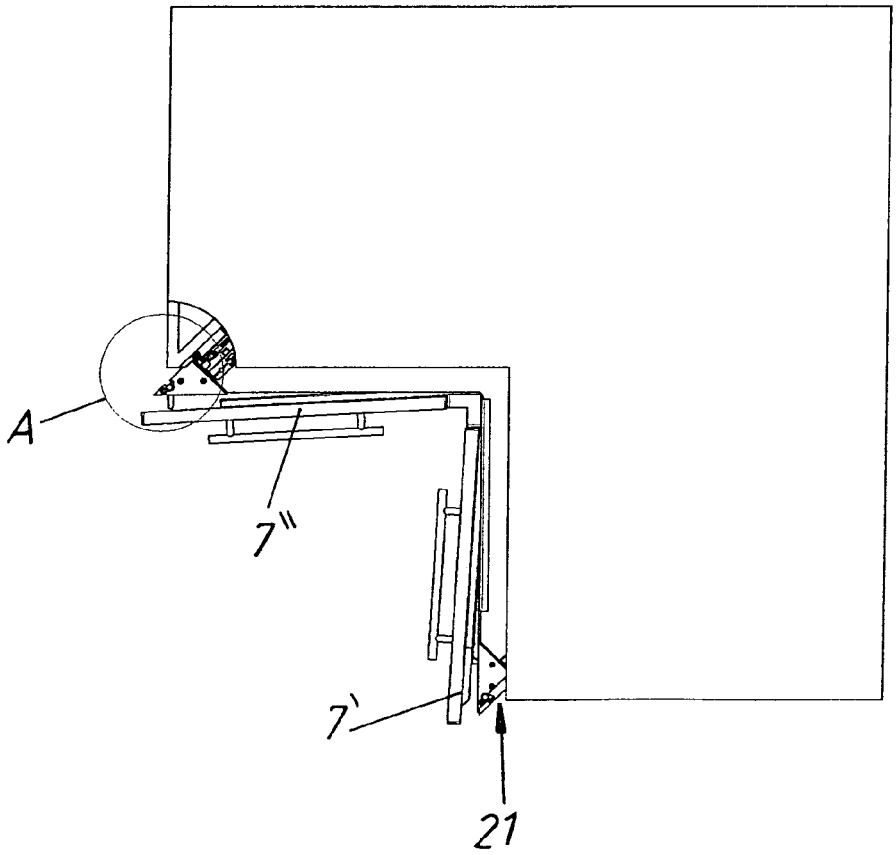

FIG. 28 shows the folding up of the front panel 4 and of the plates 7', 7", respectively, before the drawer 1 is drawn out of the body of the furniture element. FIG. 31 shows the front end of the corner front fitting 21, wherein the panel interlocking arrangement is shown. The panel interlocking arrangement ensures that the front panel 4 remains in the folded up position for as long as the drawer 1 is open, and does not strike against the adjacent front panels 41 when the drawer 1 is slid in. This is achieved by means of a locking bar 26, which interacts with a stationary guide-element 27.

Figure 33:
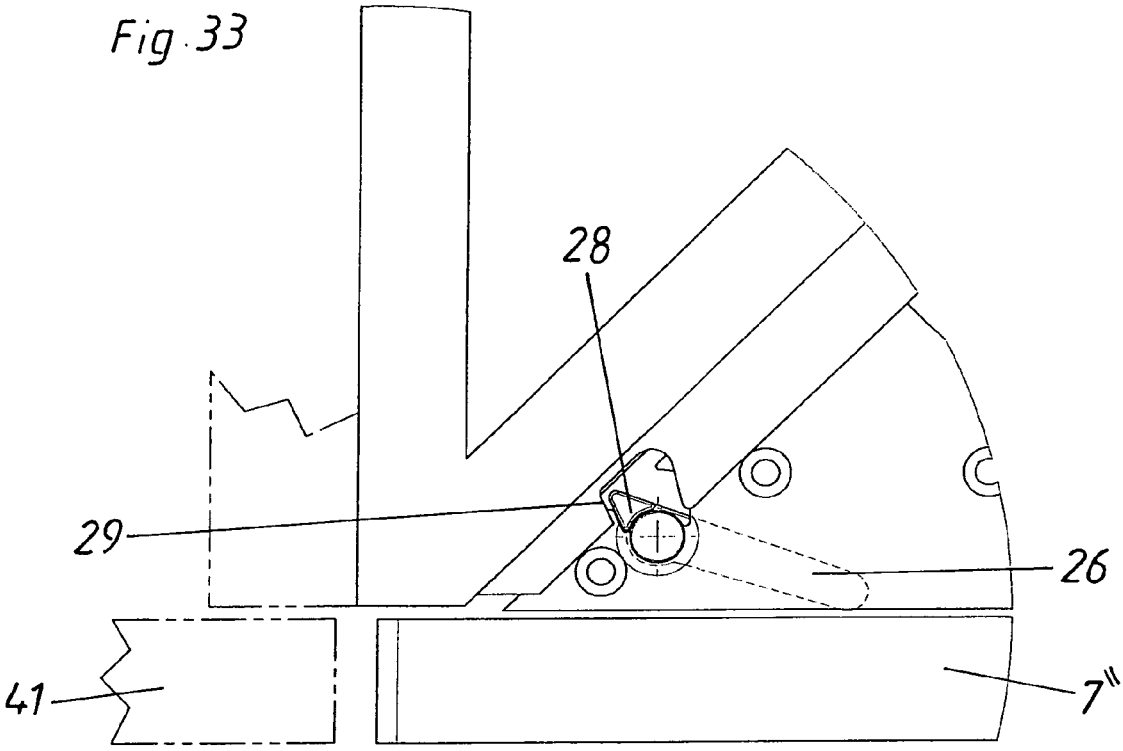
Figure 32:
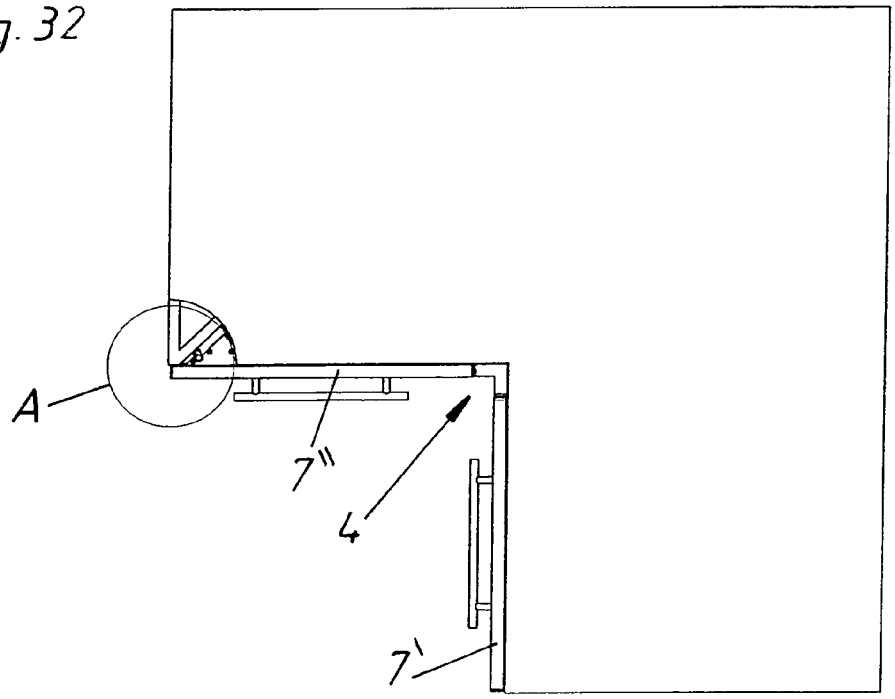
Figure 35:
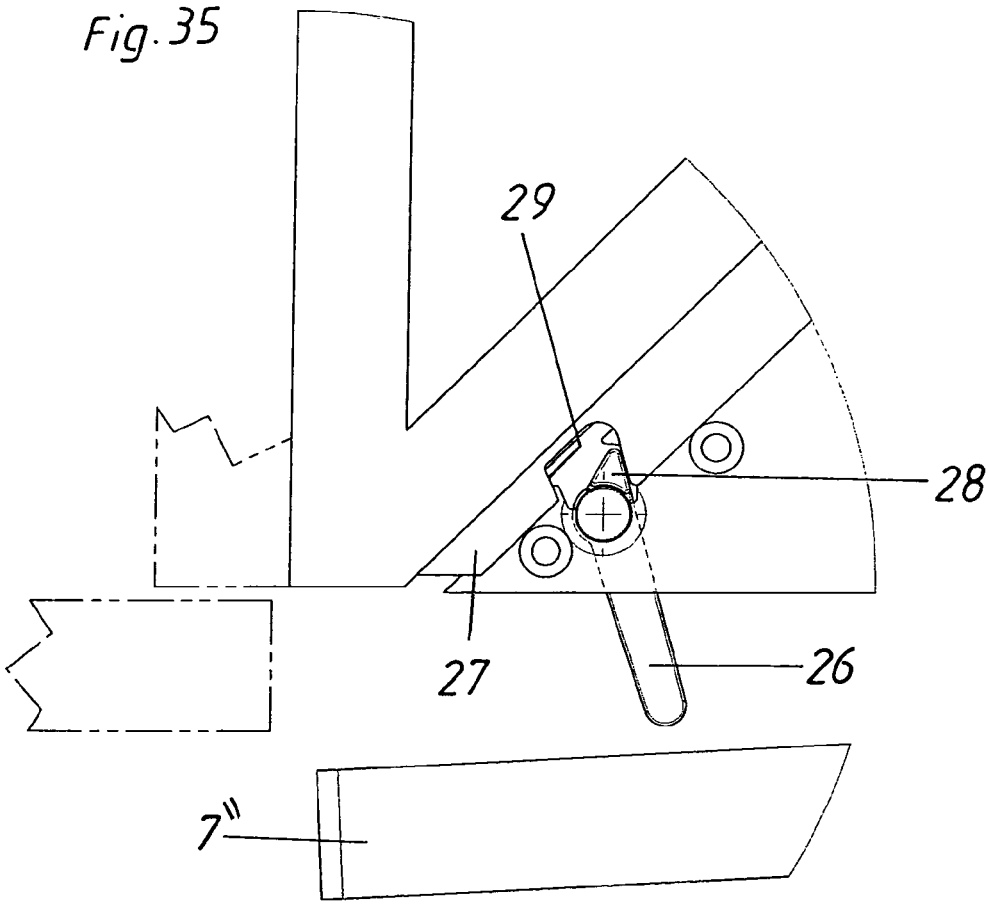
Figure 34:
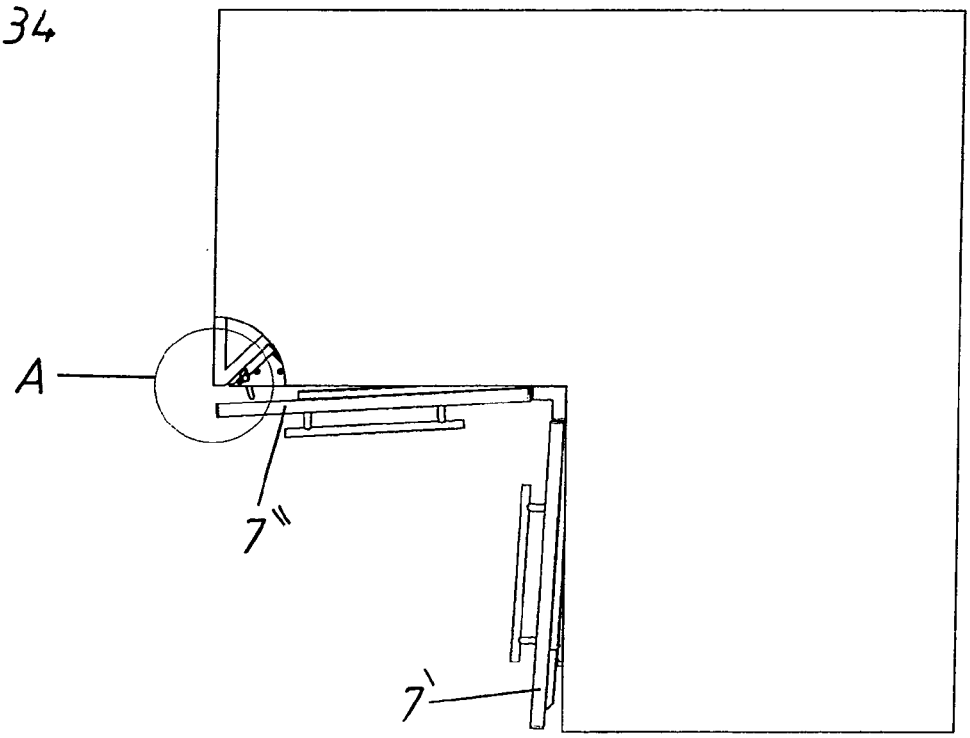

FIGS. 32 and 33 show the front panel 4 and the plates 7', 7", respectively, in the fully slid-in position of the drawer 1. Because of the nose 28 of the locking bar 26 being supported by a positive fit on an edge 29 of the guide element 27, the locking bar 26 cannot be tilted, and therefore prevents the drawer 1 from being opened. If it were possible for the drawer 1 to be opened in this position, the front panel 4 would collide with the front panels 41 of the adjacent drawers 40. FIGS. 34 and 35 show the opening of the drawer 1. First, the plates 7', 7" which form the front panel 4, are folded together in the direction of the arrow, i.e. the plates 7, 7" are pivoted about vertical axles together with the retaining parts 24. The retaining parts 24 are connected synchronously to one another in the corner front fitting 21. At the same time the spring-loaded locking bar 26 is released. The locking bar 26 can be rotated in the direction of the arrow in FIG. 35 and releases the retaining block element for the drawer 1. The drawer 1 has not yet moved, however, because it is still held in the closed position by a retraction-assisting device. For example, a suitable retraction-assisting device is described in EP 0 631 745 B 1 by the Applicant.

Figure 37:
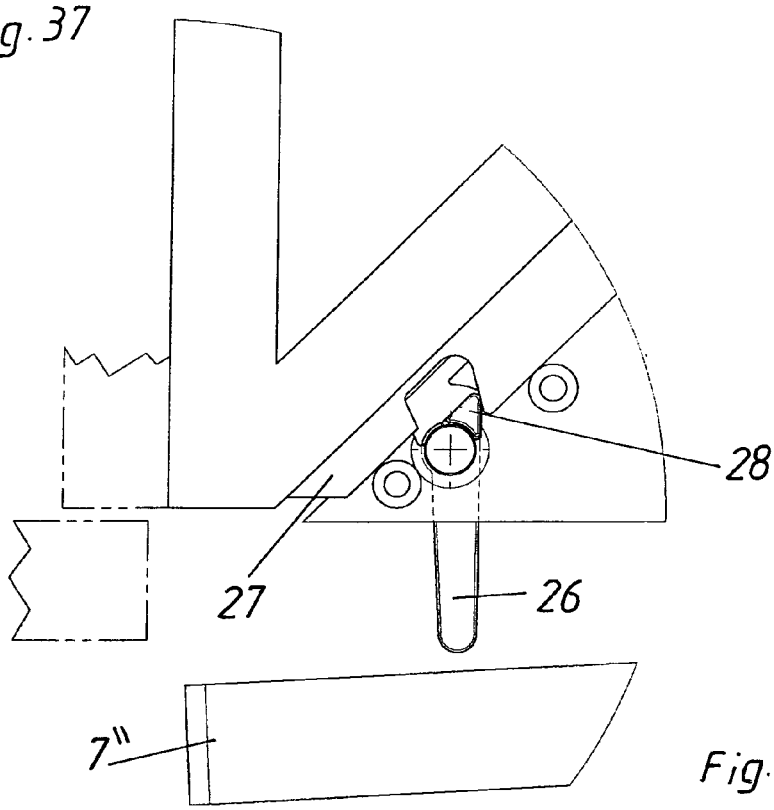
Figure 36:
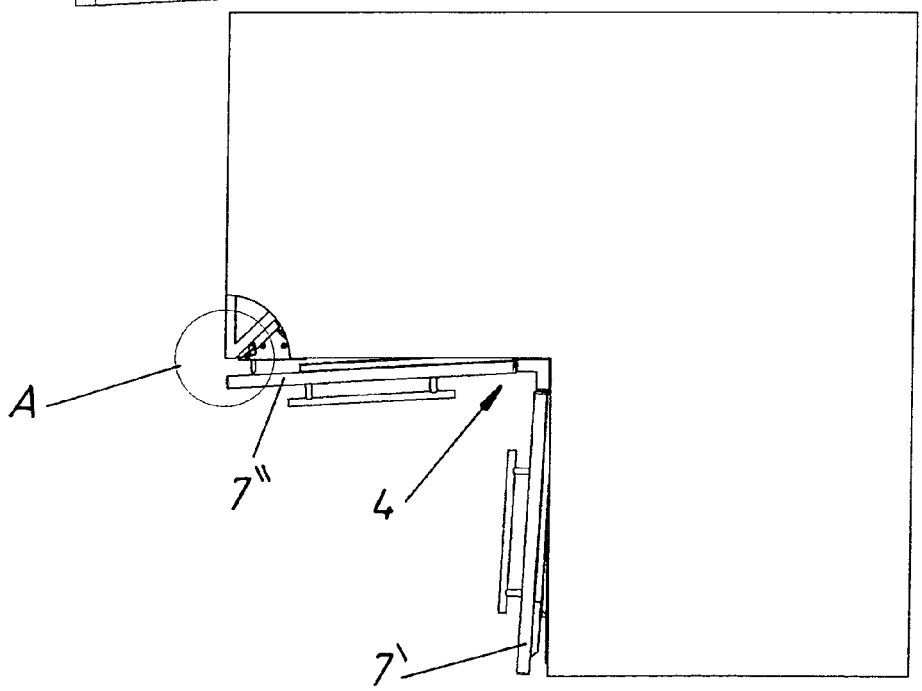

If the drawer 1 is pulled sufficiently in order to overcome the force of the retraction-assisting device, the drawer 1 is extended from within the boy of the furniture element with the plates 7', 7" folded forwards, as shown in FIGS. 37 and 36.

Figure 38:
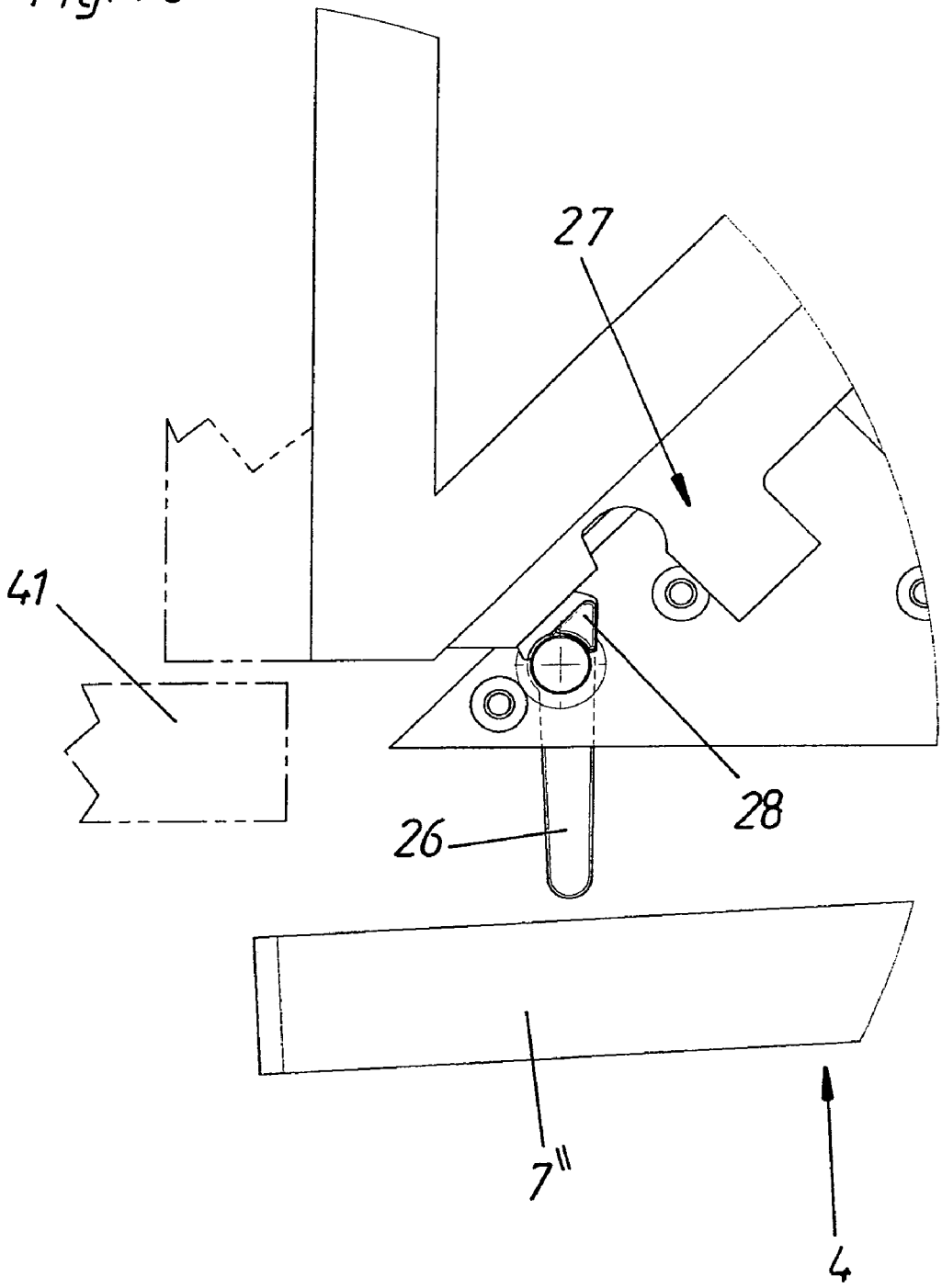

FIG. 38 shows the situation in which the drawer 1 is already opened sufficiently wide for the front panels 4 and 41 not to be able to collide any more. The control lever 26 cannot be moved back in this situation, because the guide element 27 prevents this by positive fit with the drawer in this position. A collision between the front panel 4 (plate 7',7") with the front panels 41 is therefore impossible.

Figure 39:
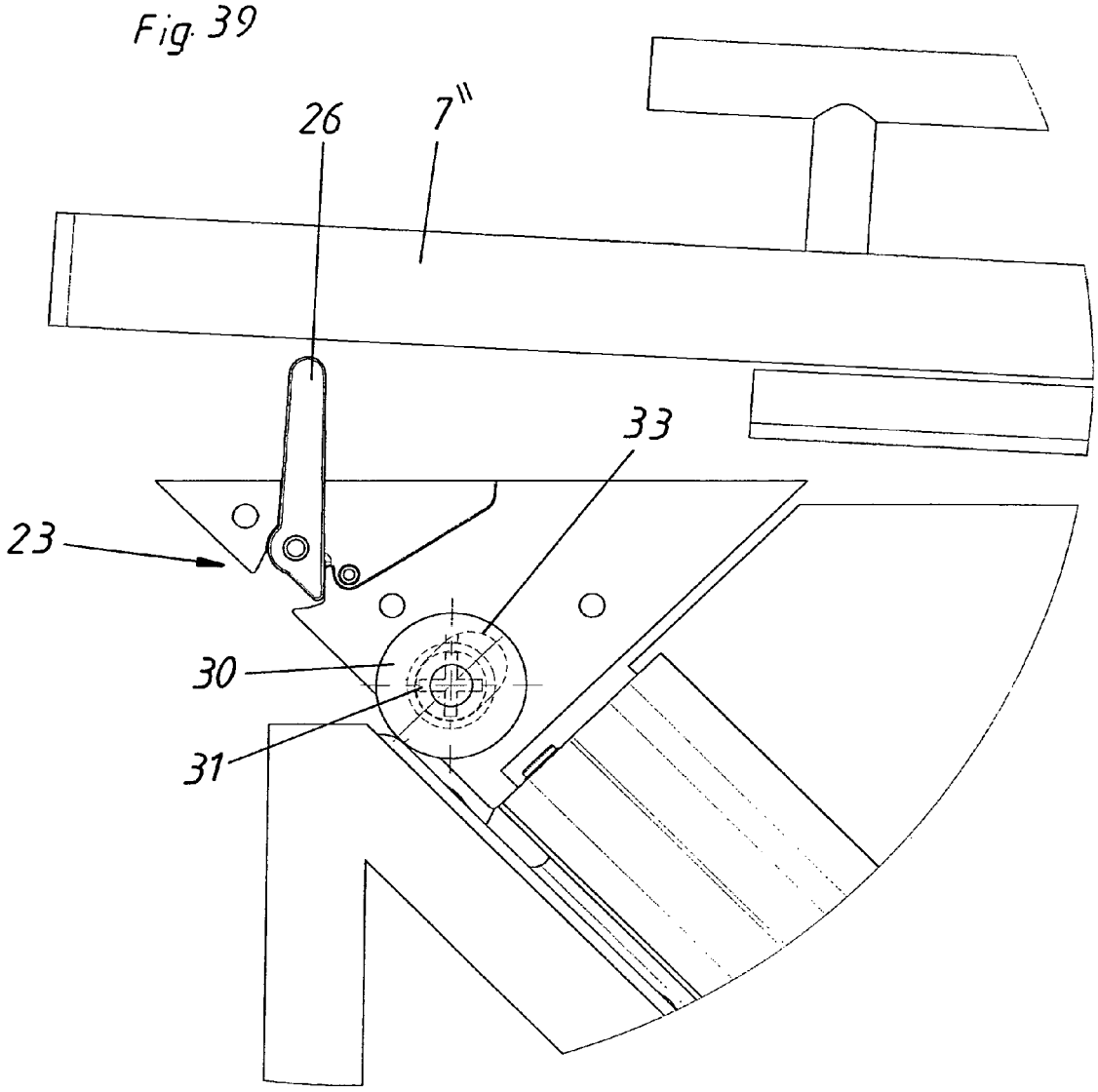
Figure 40:
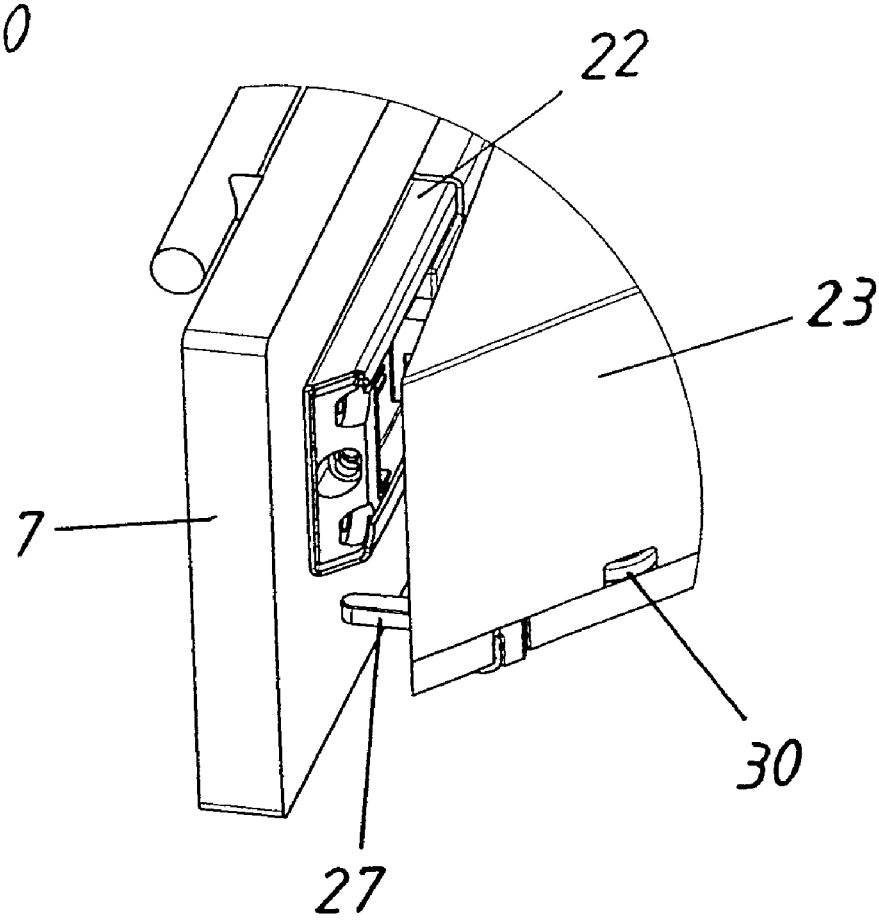

In the embodiment according to FIGS. 39 and 40, lateral compensation rollers 30 are mounted at the corner front fitting 21. The compensation rollers 30 have the effect that the drawer 1 makes as few lateral movements as possible in the opening area. Excessive lateral movements could lead to collisions between the front panel 4 and the front panels 41 despite the panel control arrangement, for example if only quite narrow joints are permitted between the front panel 4 and the adjacent panels 41. The position of each compensation roller 30 can be adjusted by means of a screw 31 and a longitudinal hole 33.

The compensation rollers 30 are located on each side of the drawer 1 and in the embodiment shown run on a fitting part 34 on the furniture body side.

Figure 41:
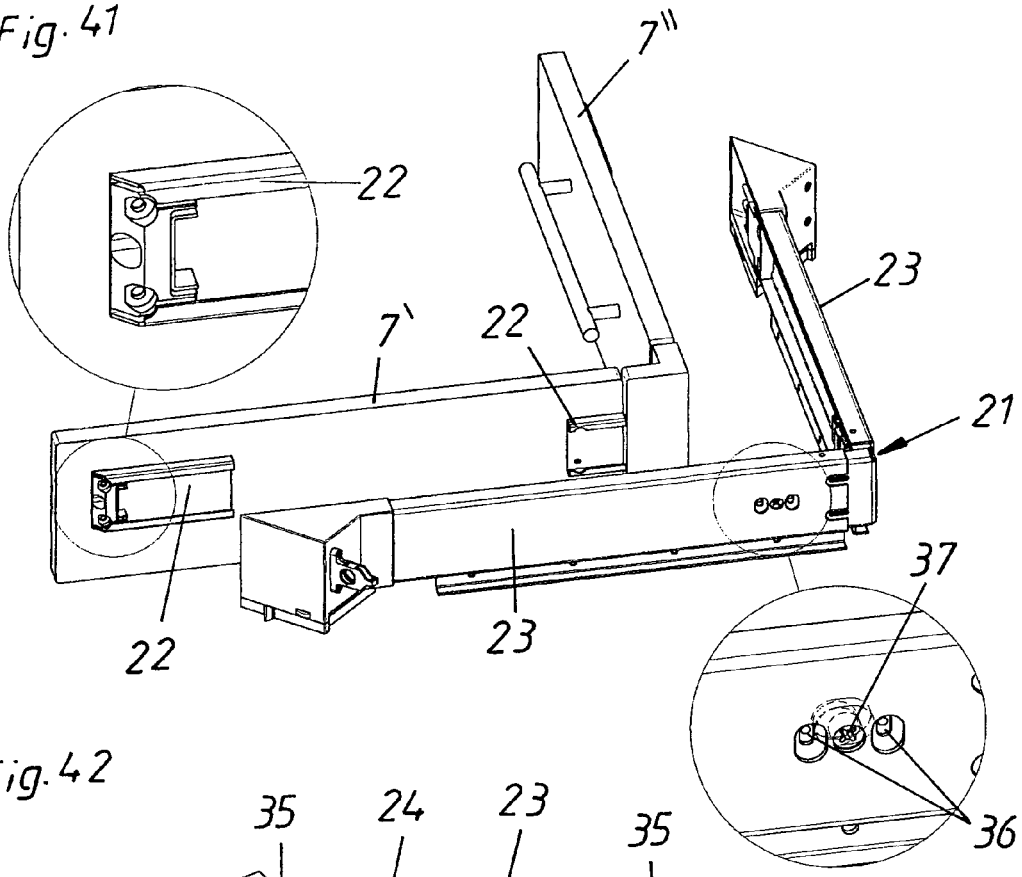
Figure 42:
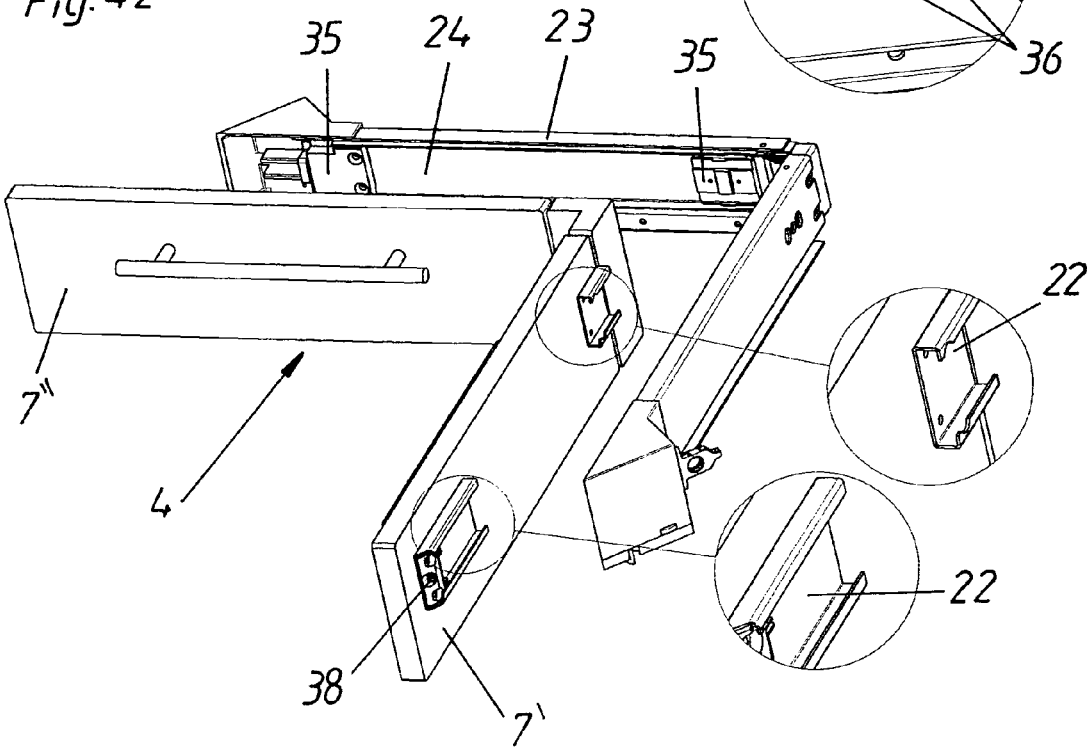
Figure 43:
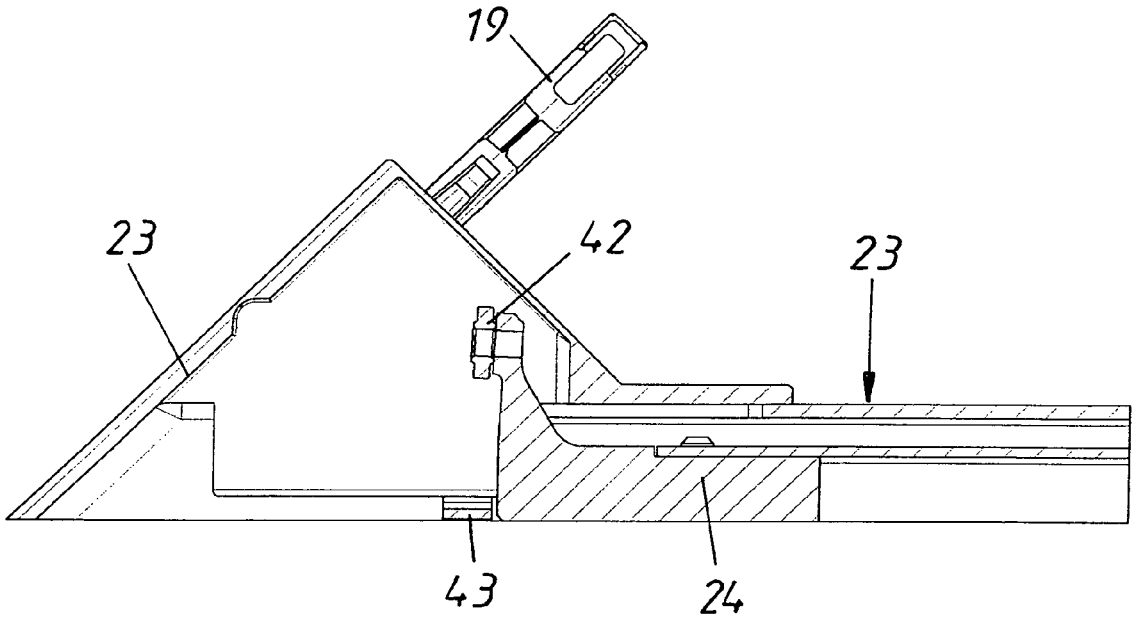
Figure 44:
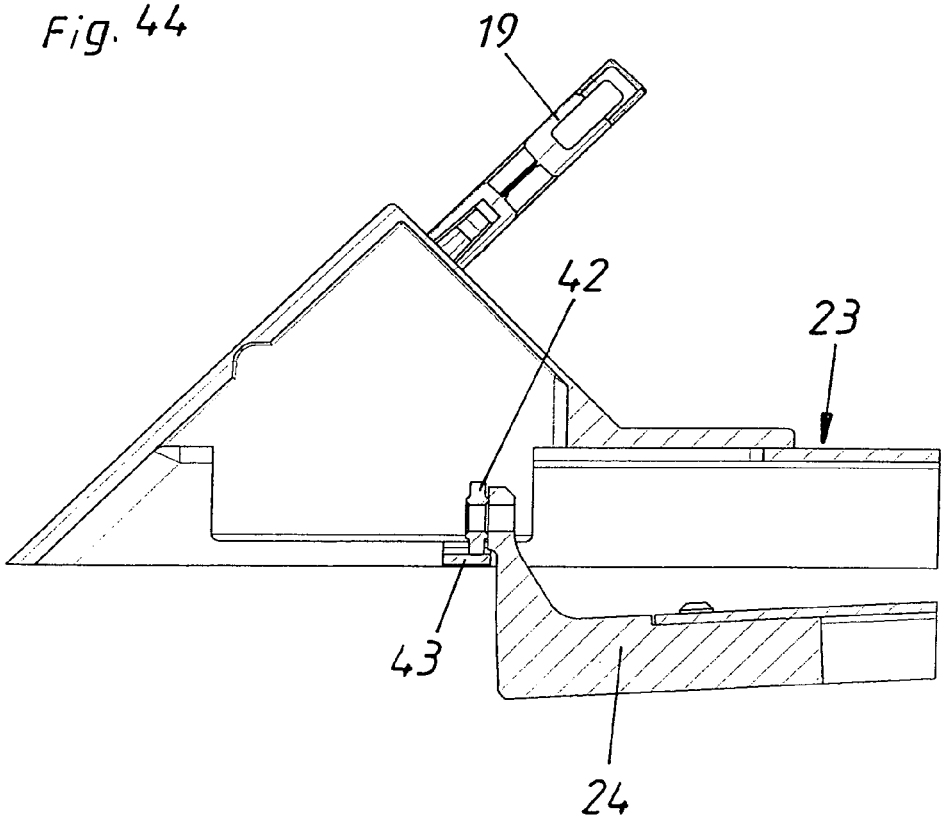
Figure 45:
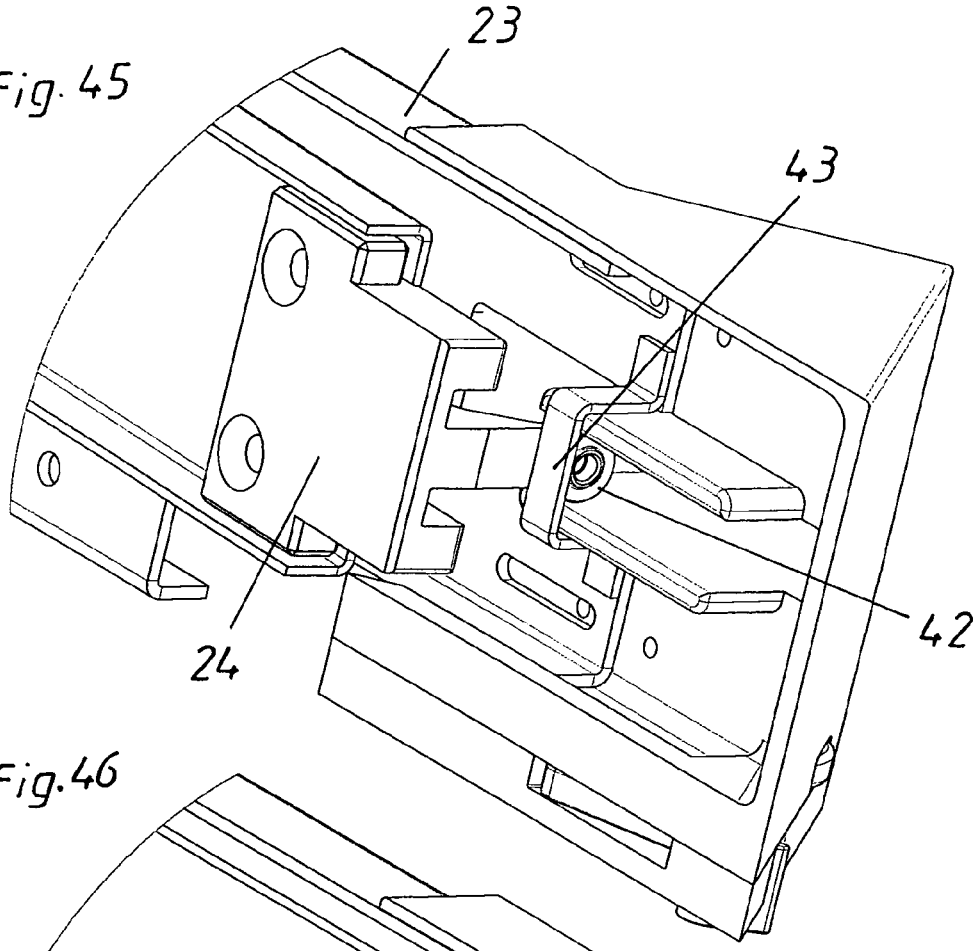
Figure 46:
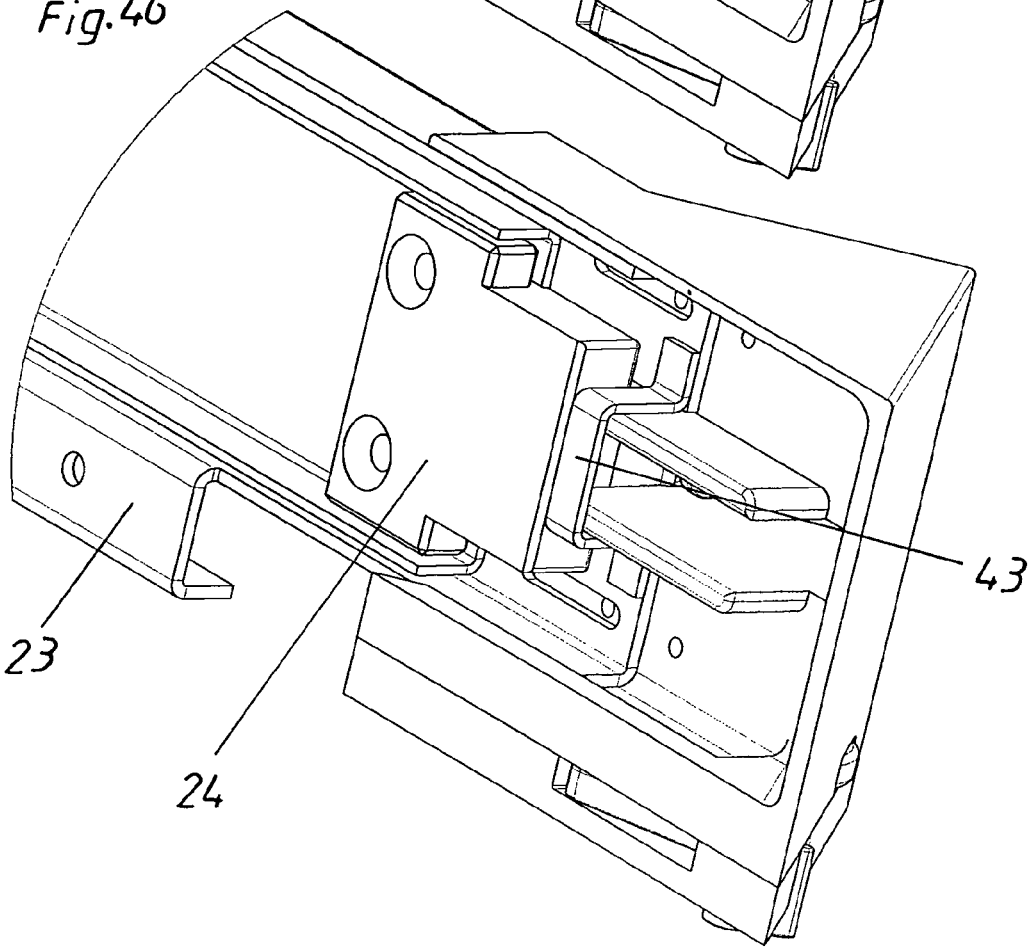
Figure 47:
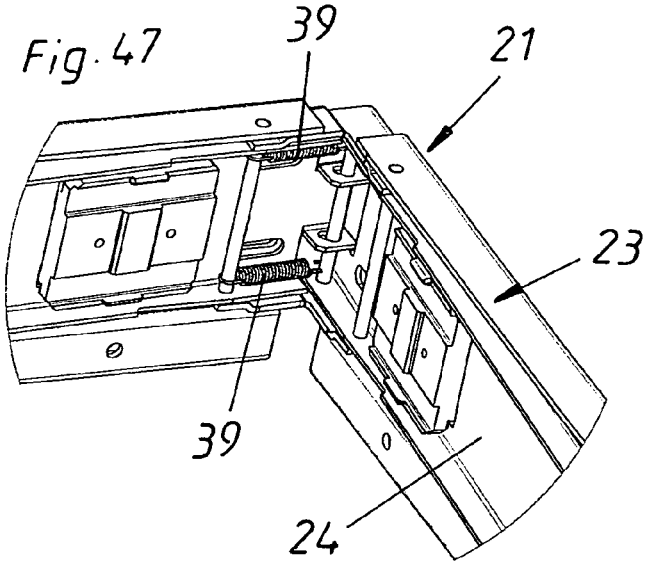
Figure 48:
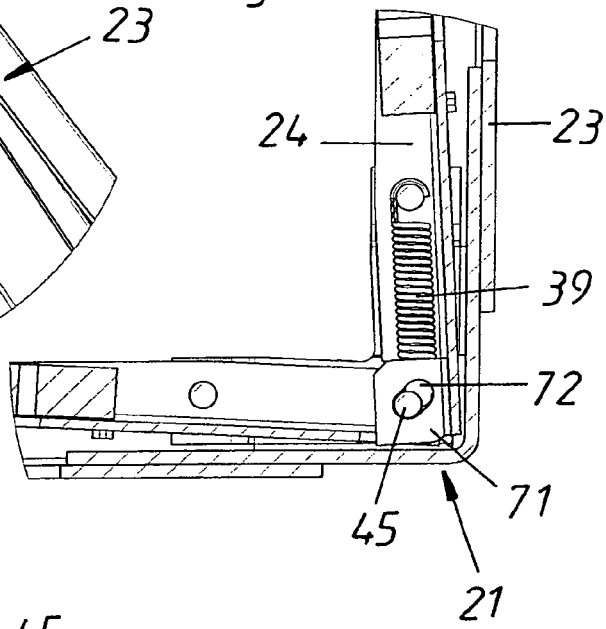
Figure 49:
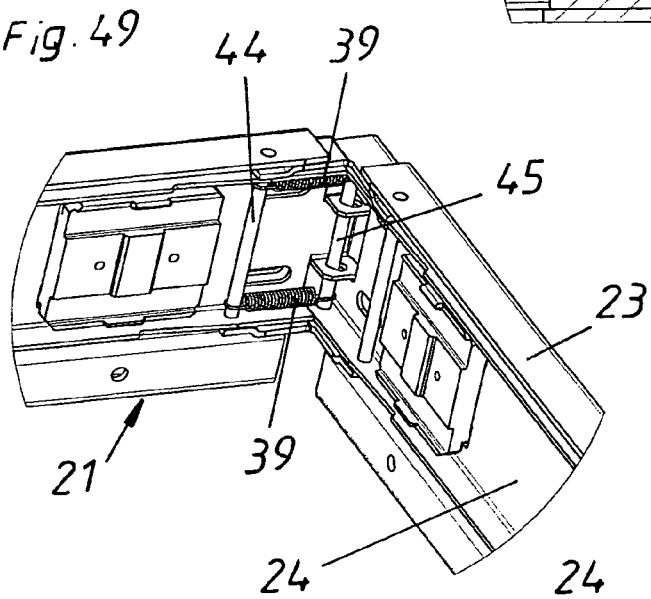
Figure 50:
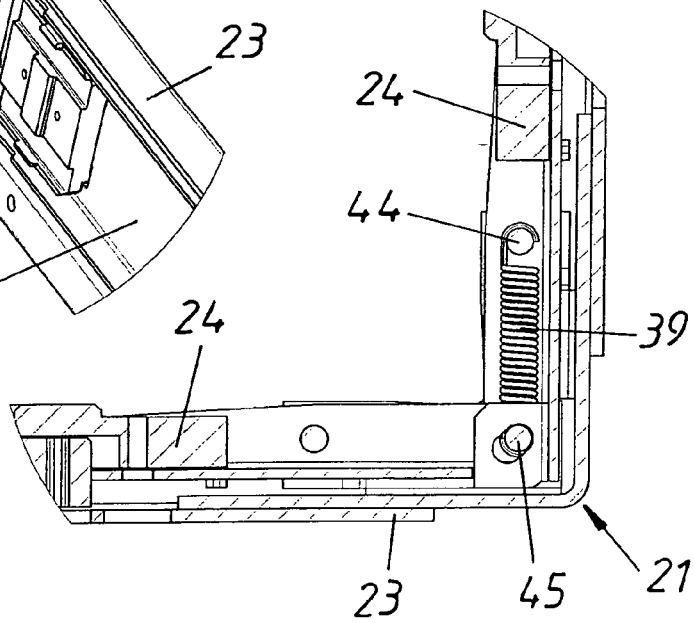
Figure 51:
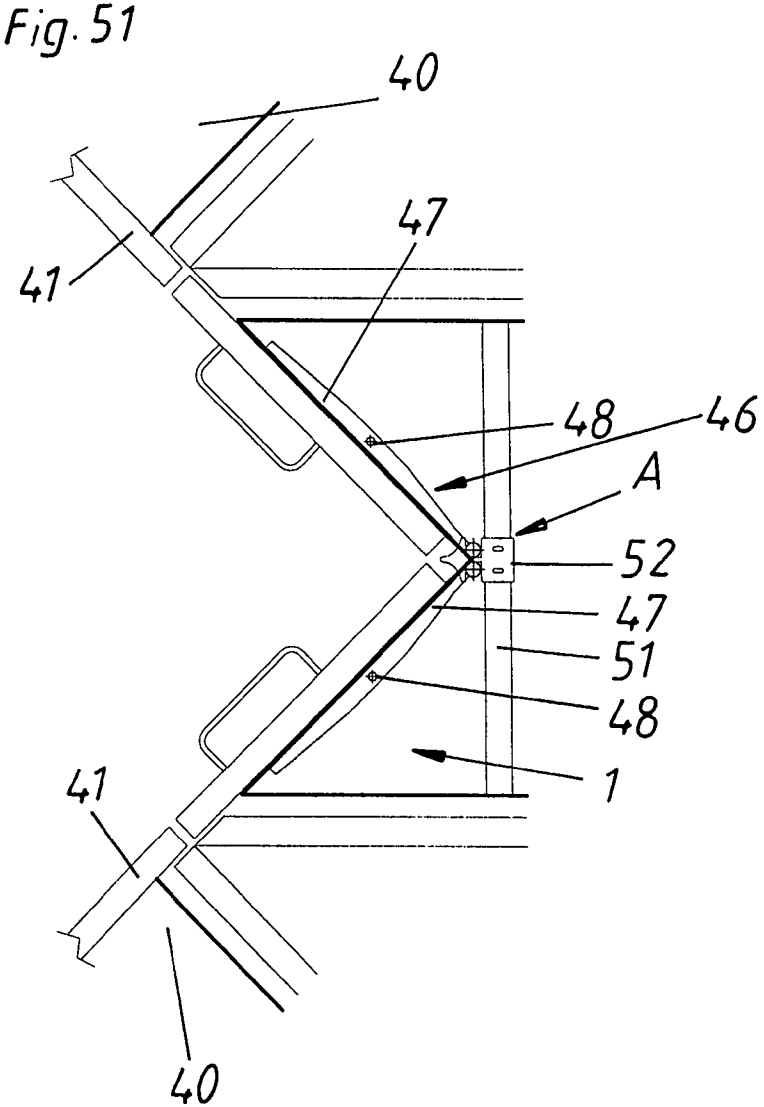
Figure 52:
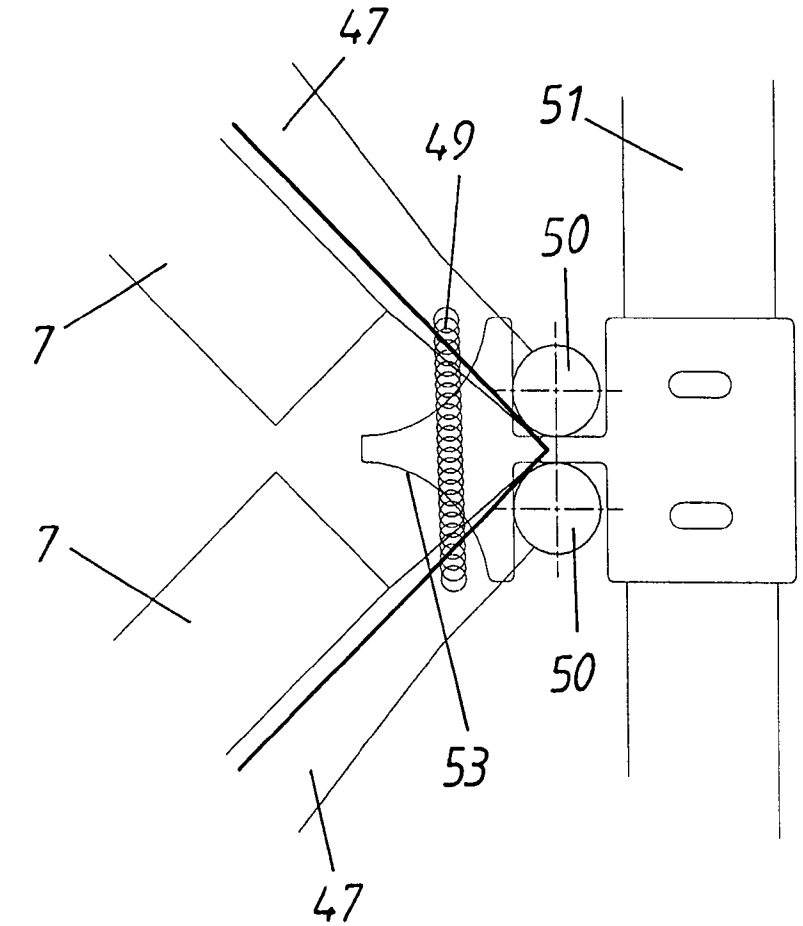
Figure 53:
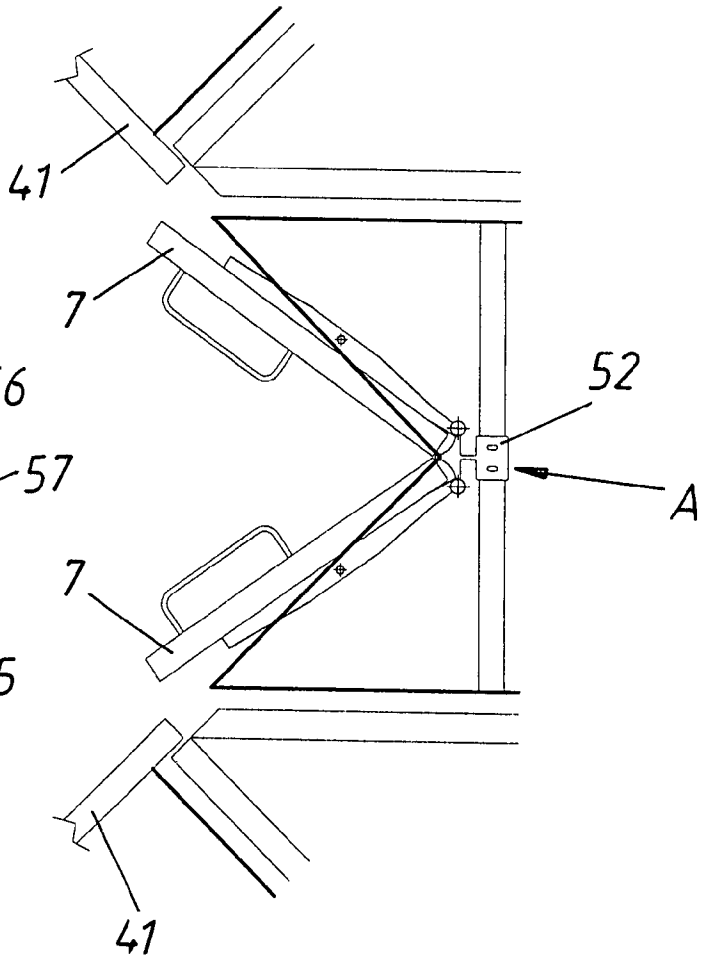

FIGS. 41 and 42 again show the corner front fitting 21 drawn apart. The securing parts 22 are mounted on the plates 7', 7" beforehand. The plates 7',7" are slidably engaged in the direction of the arrows onto the corner front fitting 21, and specifically in such a way that the securing parts 22 are slidably engaged onto corresponding accommodation parts 35. The accommodation parts 35 are connected to the retaining parts 24. The plates 7 are connected by friction fit to the retaining parts 24 by means of clamping screws 36. When the clamping screws 36 are released, a side adjustment of the plates 7', 7" in the direction of the arrow S is possible.

It is also possible to perform an independent height adjustment, because the connection between the securing parts 22 and the accommodation parts 35 is multi-part. The adjustment is made by way of adjustment means 37 and 38.

FIGS. 43 to 46 show the pivot delimitation of the retaining parts 24. Stops 42 are provided at the retaining parts 24, and counter-stops 43 at the carrier part 23, which delimit the pivot path of the retaining parts 24. In FIGS. 48 to 51 the springs 39 are shown, which connect the retaining parts 24 to one another. The springs 39 are suspended in pins 44, 45. The pin 44 is securely anchored in the retaining part 24. The pin 45 rests in longitudinal holes 72, which are formed in lugs 71 of the second retaining part 24.

If only one of the plates 7', 7" is pulled by an operator, the other of the plates 7', 7" automatically folds with it, as a result of which a collision with the front panels 41 of the adjacent drawers 40 on both sides of the drawer 1 is avoided.

The embodiment from FIGS. 51 to 62 is described hereinafter.

The drawer 1 is again provided with an angled front panel 4. The front panel 4 is formed by two plates 7', 7", which are mounted on the corner front fitting 46 according to the invention. On both sides of the drawer 1, which is located in the corner of the cabinet, there are arranged conventional drawers 40 with front panels 41. The plates 7', 7" are mounted on retaining parts 47, which are mounted so as to be able to pivot about axles 46 at the drawer 1.

The axles 48 can be directly secured to the drawer 1, or by means of a carrier part 23 of the embodiment described heretofore.

The retaining parts 47 are connected at their areas located in the corner by a spring 49.

Figure 54:
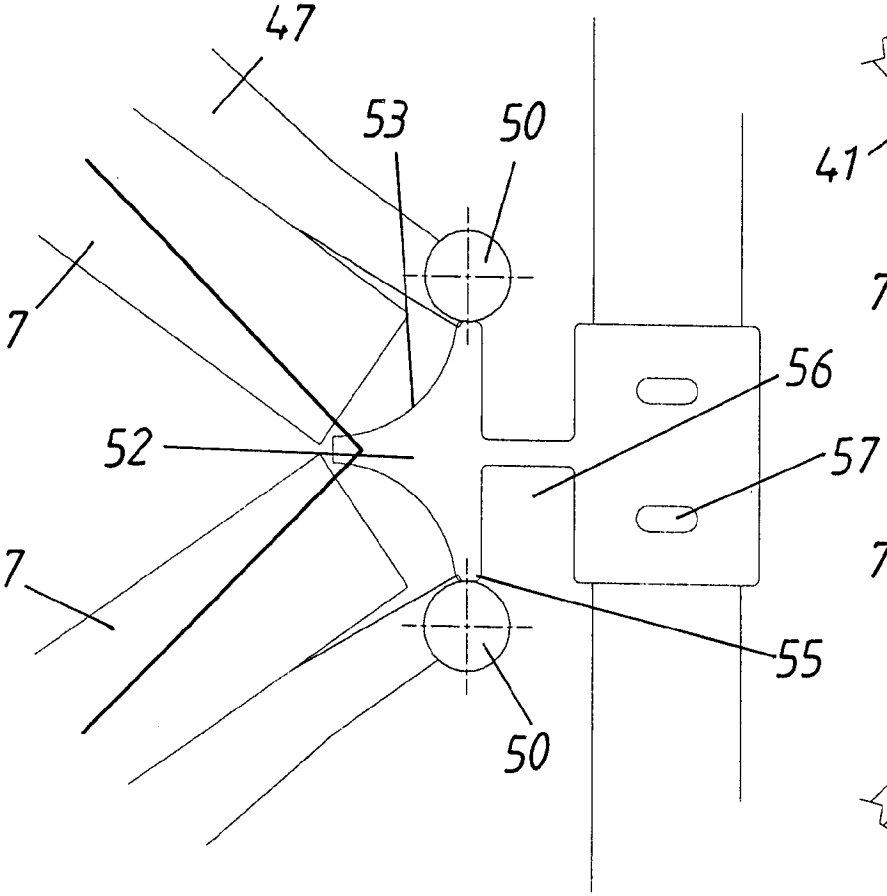
Figure 55:
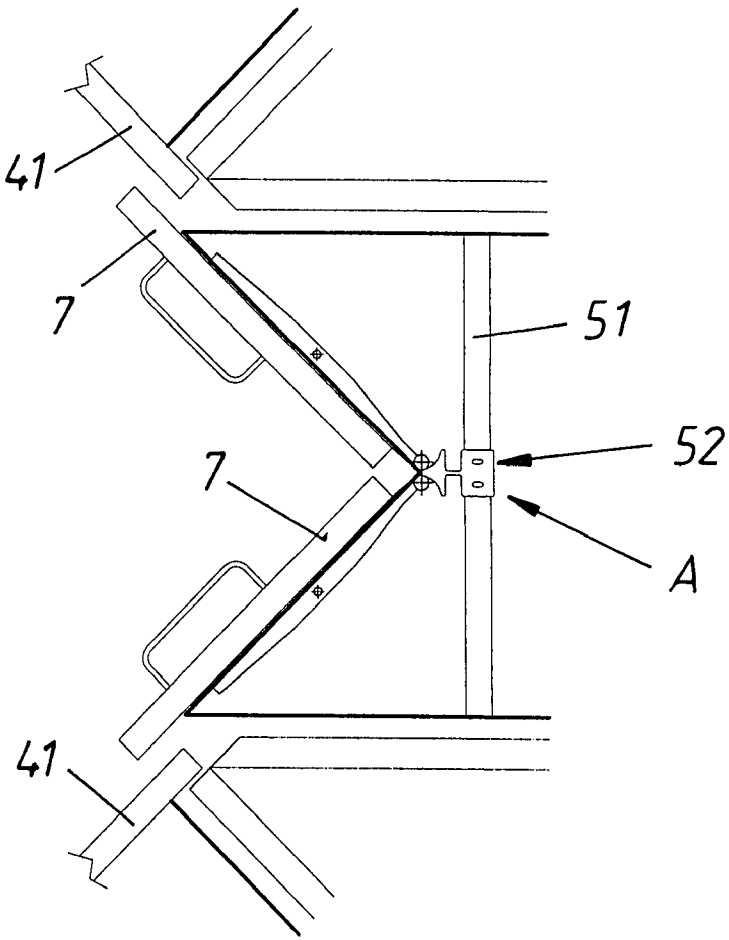
Figure 56:
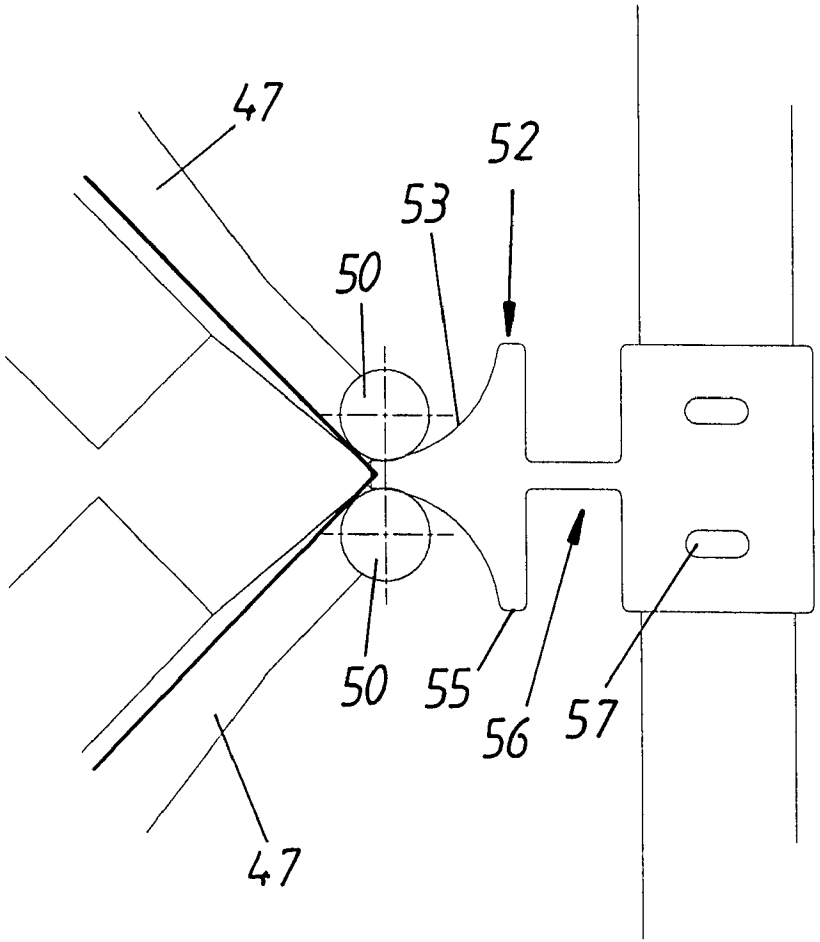
Figure 57:
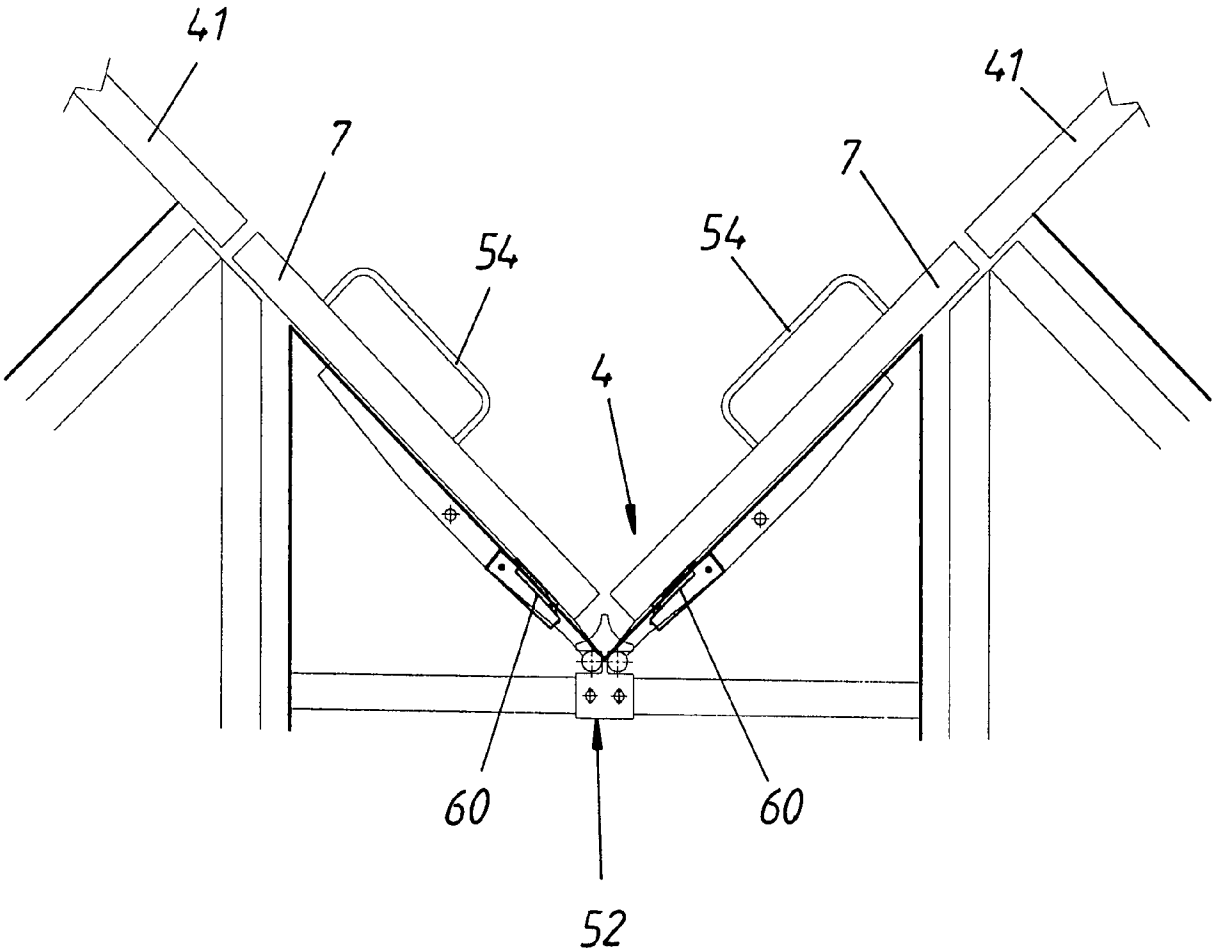
Figures 58, 59, 60:
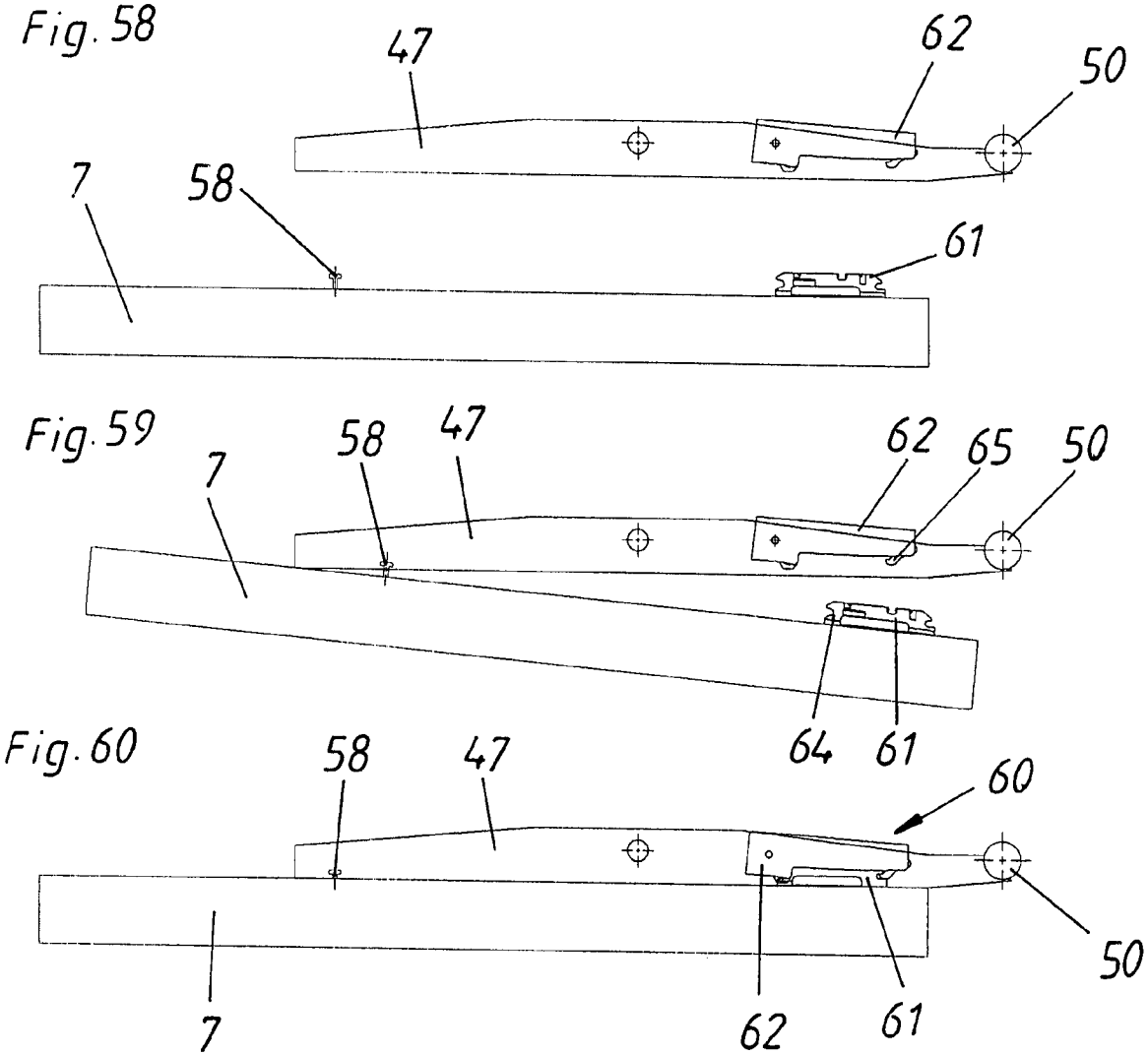
Figure 62:
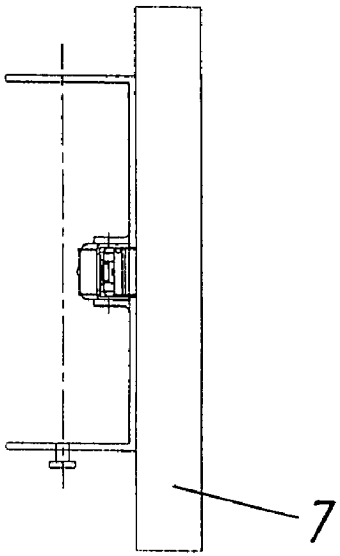
Figure 61:
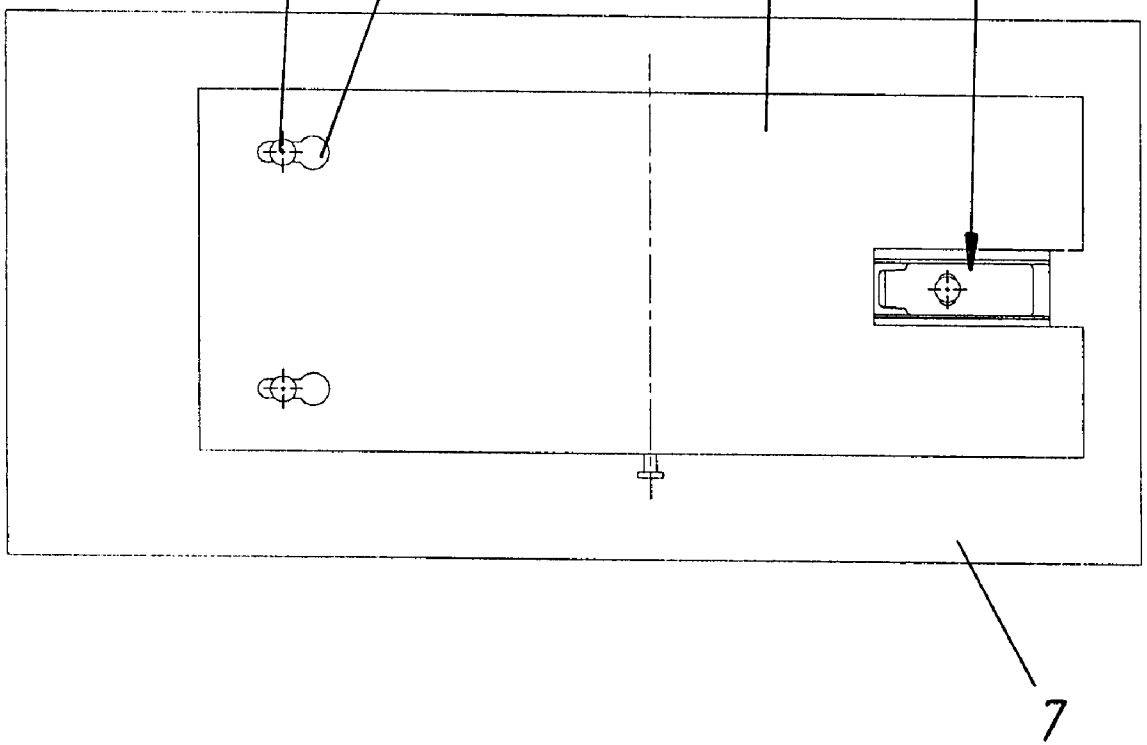

In addition, each retaining part 47 carries a running roller 50 in the corner area. A control part 52 is secured along a brace 51 of the body of the furniture element 1, on which two guide tracks 53 are formed, on which the running rollers 50 run when the drawer 1 is opened and closed. The retaining parts 47 are pressed by the spring 49 with the running rollers 50 onto the guide tracks 53. If one of the panel handles 54 is pulled, the running rollers 50 move outwards. The plates 7', 7" fold apart to the rear and together to the front, wherein the drawer 1 remains stationary until the running rollers 50, as shown in FIGS. 54, 55, are located at the outer edges 55 of the guide tracks 53. The plates 7', 7" now cannot collide with the adjacent front panels 41. When the drawer 1 is opened, the plates 7', 7" can fold together to the rear again, since the front panels 41 of the adjacent drawers 40 can no longer come in contact.

When the drawer 1 is closed, the plates 7 and therefore the front panel 4 are controlled in the reverse sequence, so that the front panels 41 cannot come in contact, i.e. the control rollers 50 run to the rear closure area along the curves sections of the guide tracks 53 to the rear, go beyond the edges 55, and engage at 56 in the control part 52.

The position of the control part 52 in the body of the furniture element can be positioned in the longitudinal direction of the brace 51 and by means of longitudinal holes 57 transverse to the brace 51.

The mounting of the plates 7 to the retaining parts 47 is achieved on the one hand by means of a screw 58, screwed in each case into the plates 7', 7", which projects into a longitudinal hole 59 in the retaining part 47 and, on the other hand, by means of a retaining device 60.

The retaining device 60 comprises on the one hand a mounting plate 61 secured at a plate 7', 7", and a retaining arm 62 mounted at the retaining part 47. An intermediate piece 63 is mounted in the retaining arm 62.

The intermediate piece 63 carries on the one hand a tilting lever 65, and on the other hand a pin 66, which—during the mounting of the plate 7—can be suspended into a notch 64 of the mounting plate 6*lat* the retaining part 47. The tilting lever 65 is acted upon by a spring.

The retaining arm 62 is suspended with the intermediate piece 63 into the mounting plate 61 in such a way that the pin 66 engages in the notch 64. The plate 7 is then rotated about the bearing formed by the pin 66 and the notch 64, until the tilting lever 65 engages behind the projection 66 of the mounting plate 61. Because the intermediate piece 63 is retained by corresponding adjustment means at the retaining arm 62, an adjustment of the position of the plate 7 transversely to the retaining part 47 and in the longitudinal direction of the retaining part 47 is possible.

Figures 63, 64, 65:
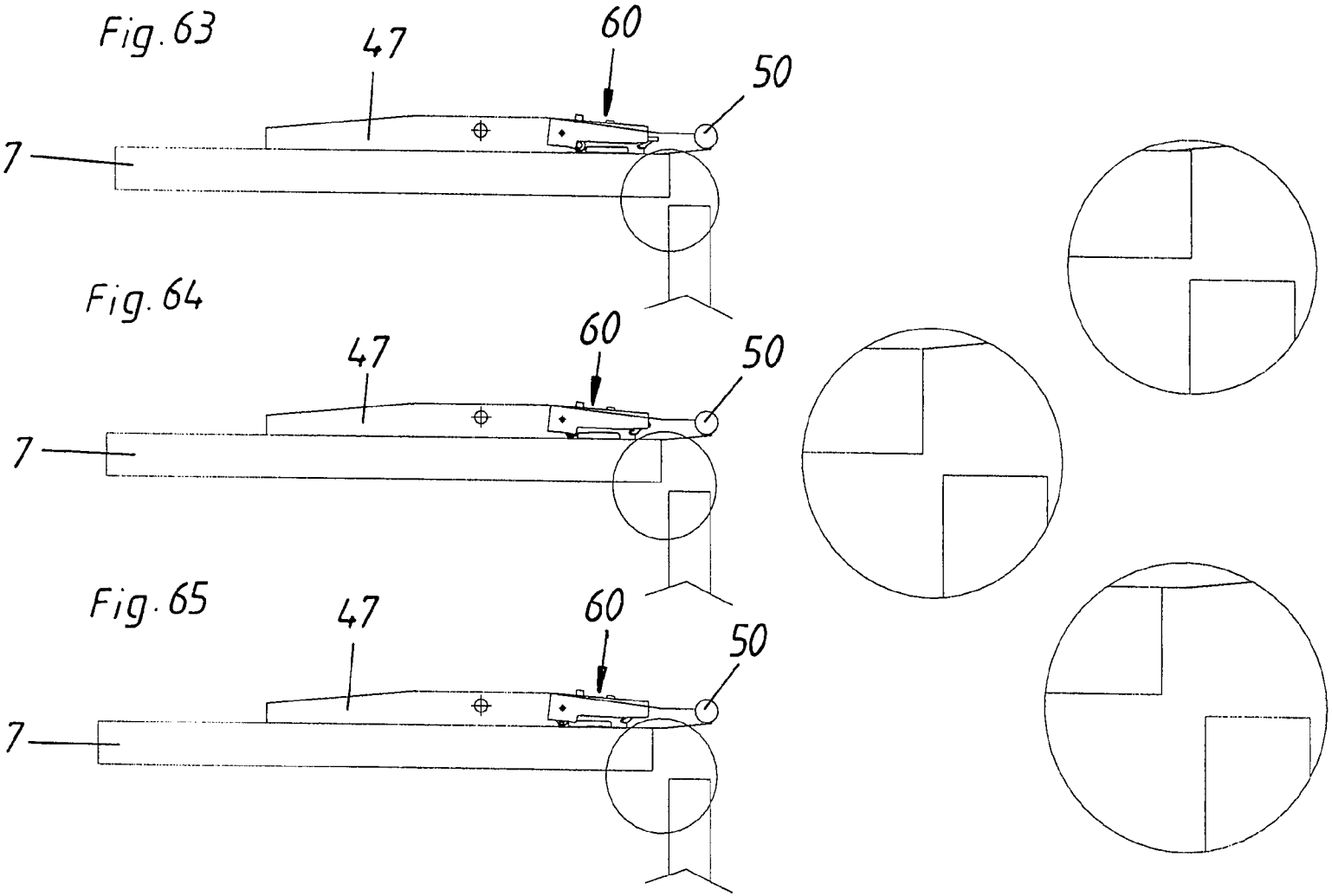
Figure 66:
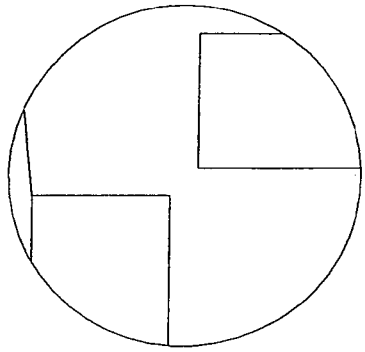
Figure 66:
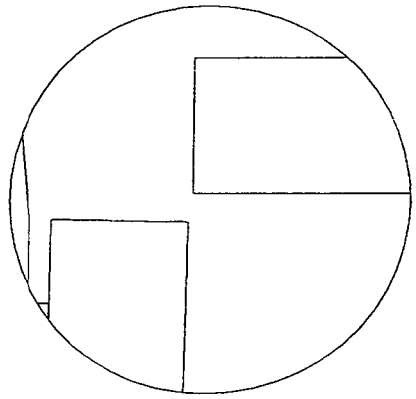
Figure 66:
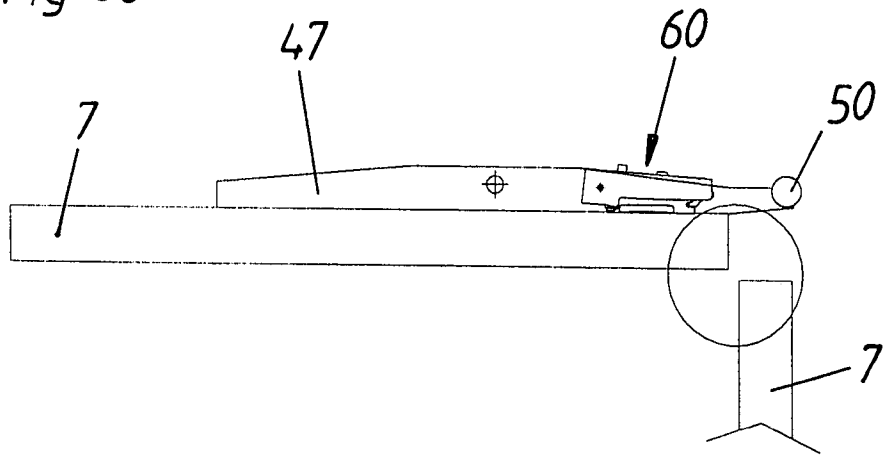
Figure 67:
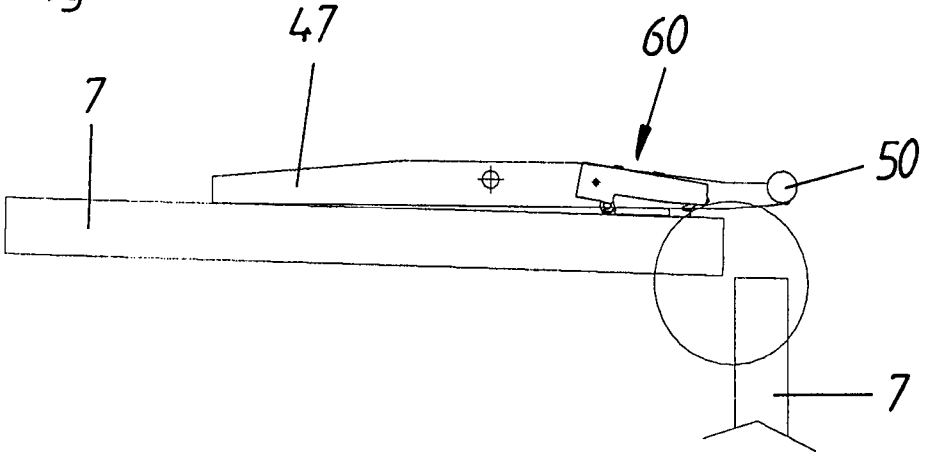
Figure 70:
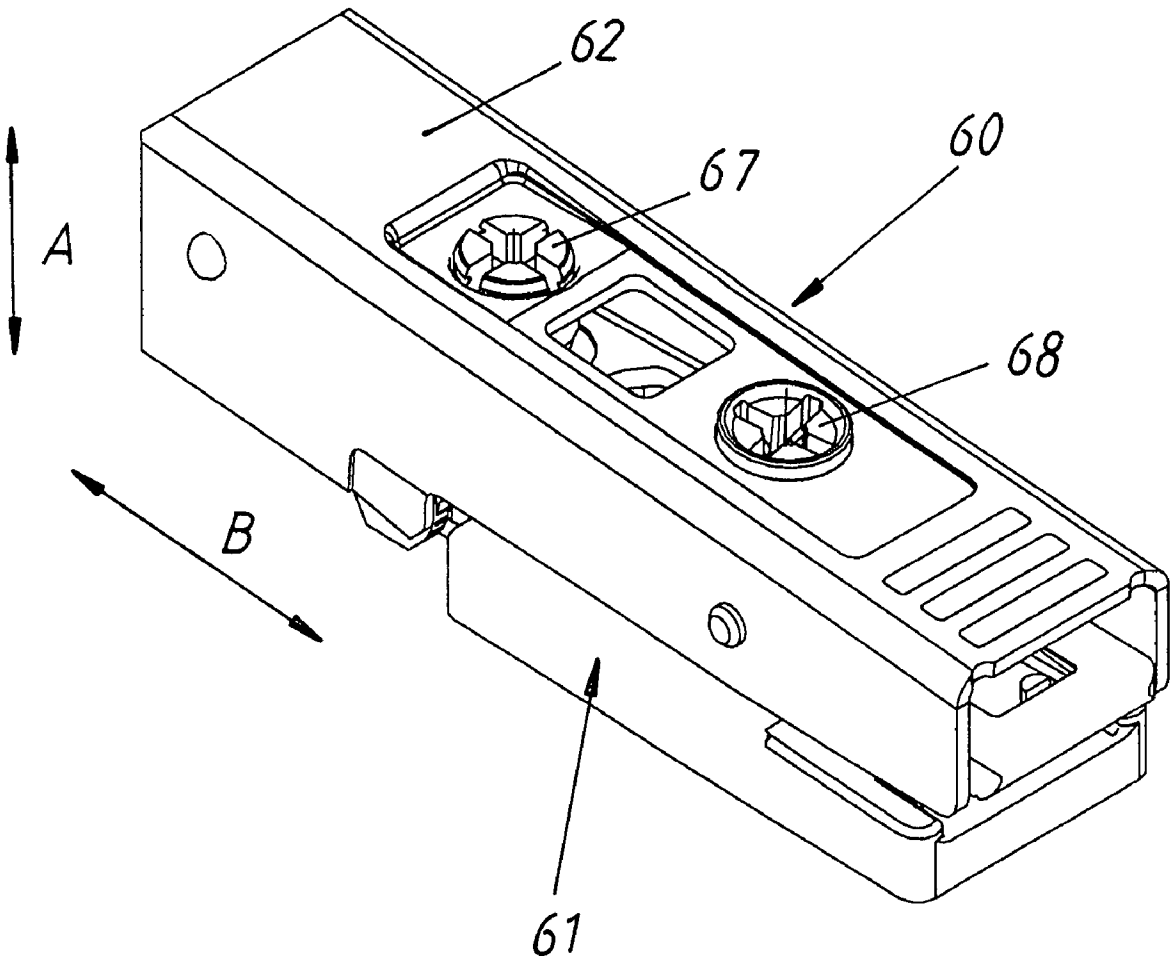
Figure 71:
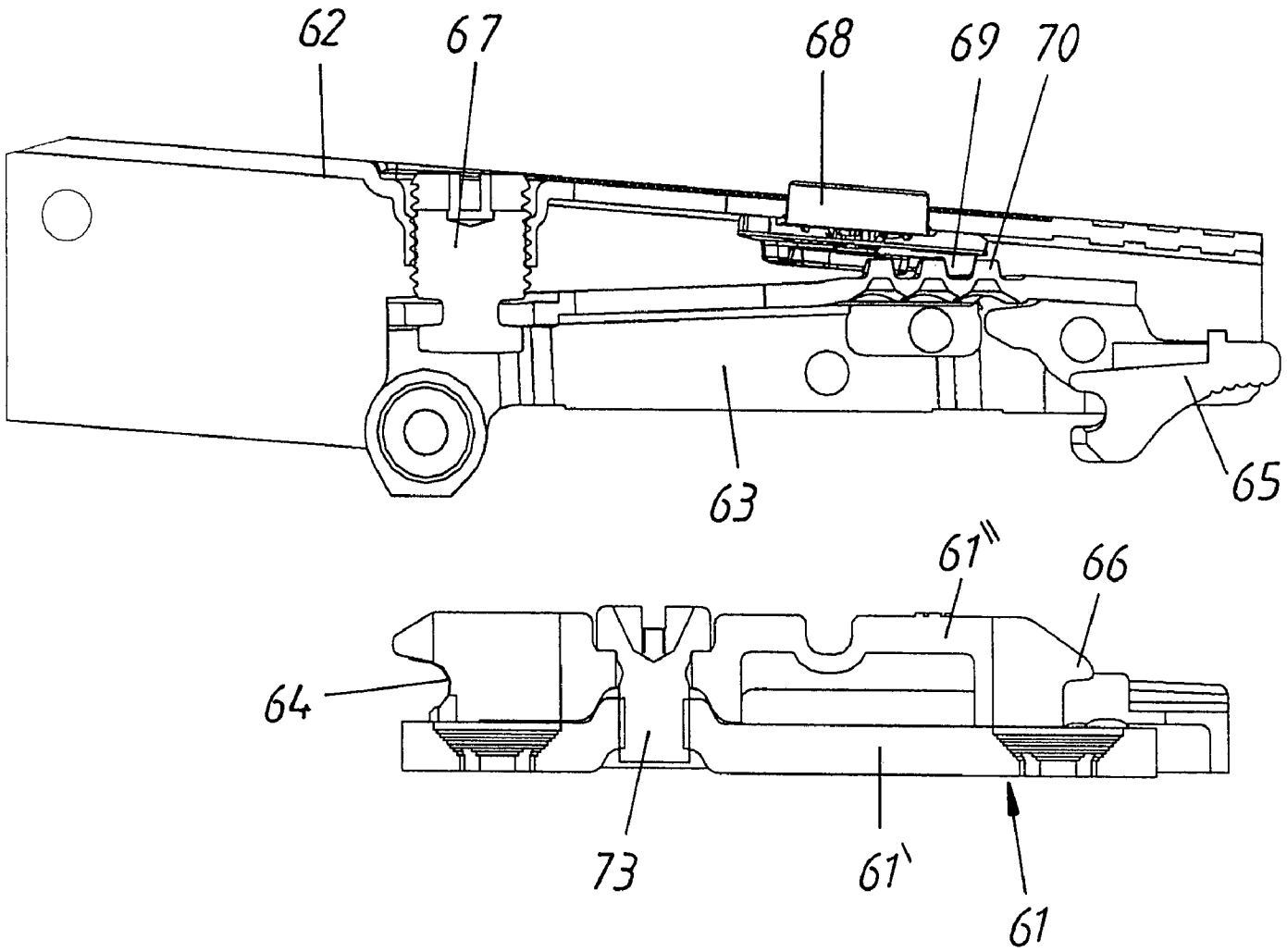
Figure 72:
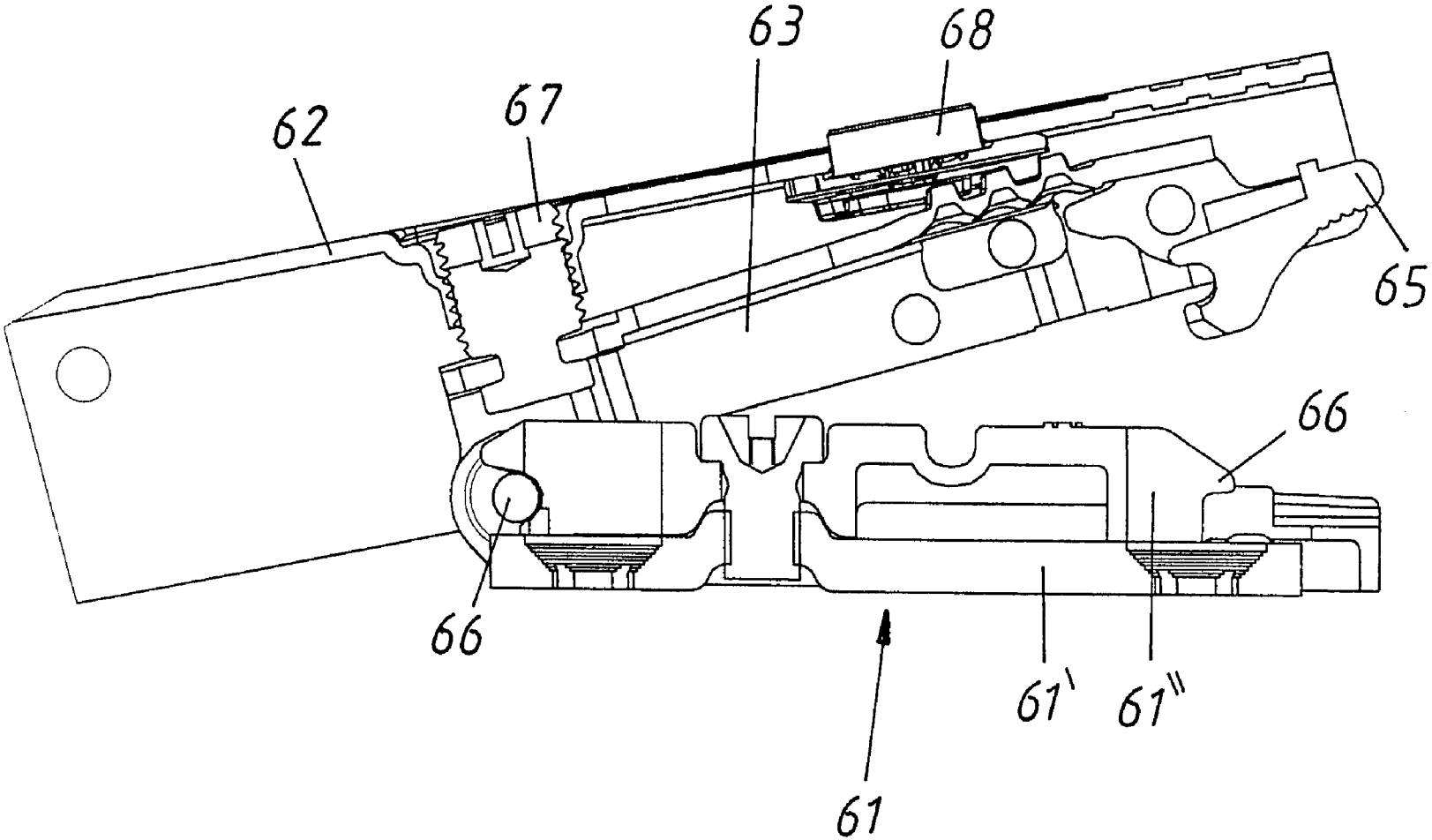
Figure 73:
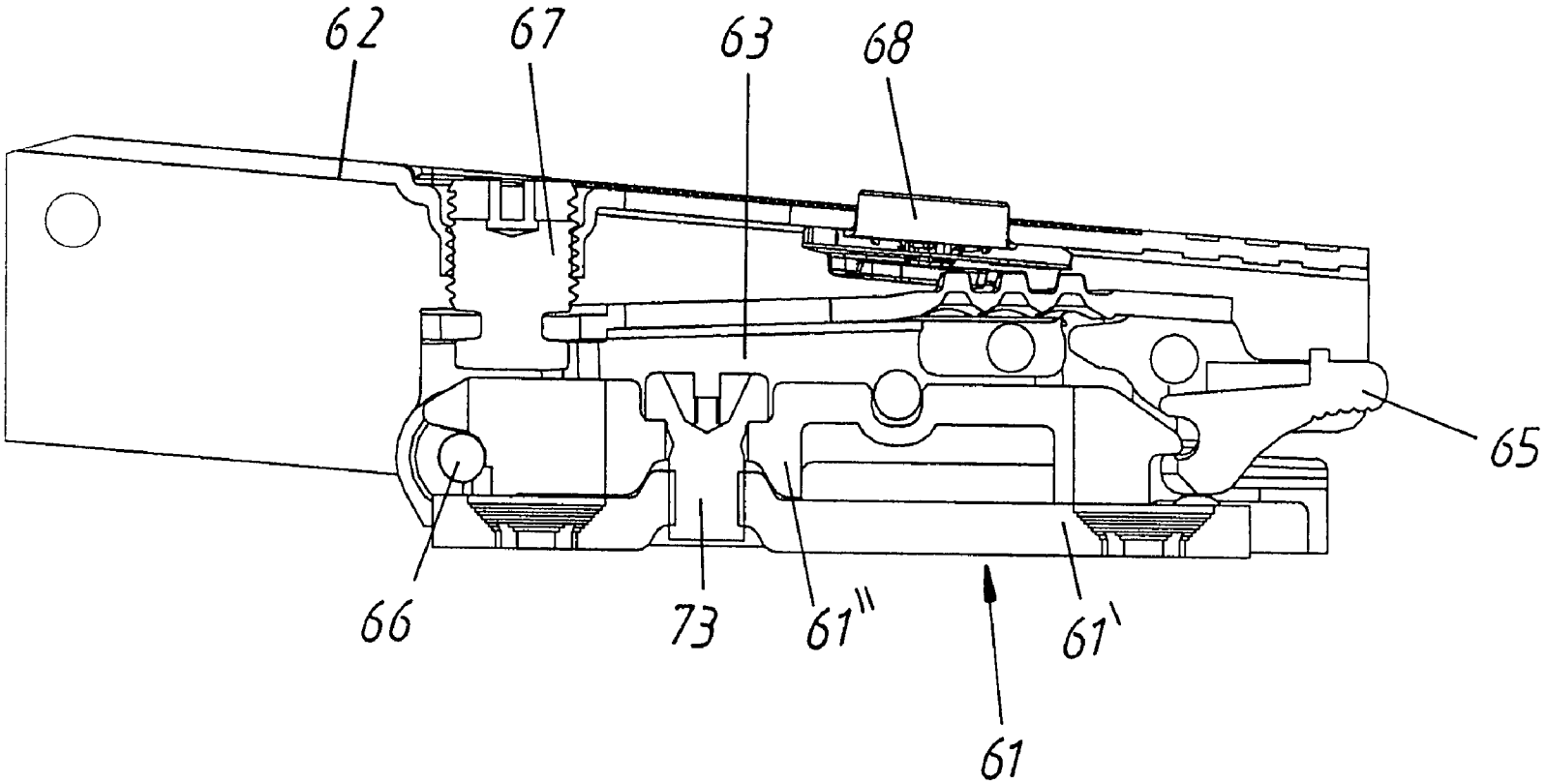

The adjustment means are formed by a setting screw 67 and a helical disk 68, of which the helical projection 69 engages behind projections 70 of the intermediate part 63. By rotating the setting screw 67, the retaining arm 62 is moved in the direction of the double arrow A in FIG. 70, and the plate 7 is therefore moved in the direction of the depth of the drawer 1 (see FIGS. 66 and 67). By rotating the helical disk 68, the plate 7 is moved in the direction of the double arrow B and therefore laterally adjusted (see FIGS. 63, 64, 65).

The mounting plate 61 consists of two parts 61' and 62". The two parts are clamped together by a screw 73.

Figure 68:
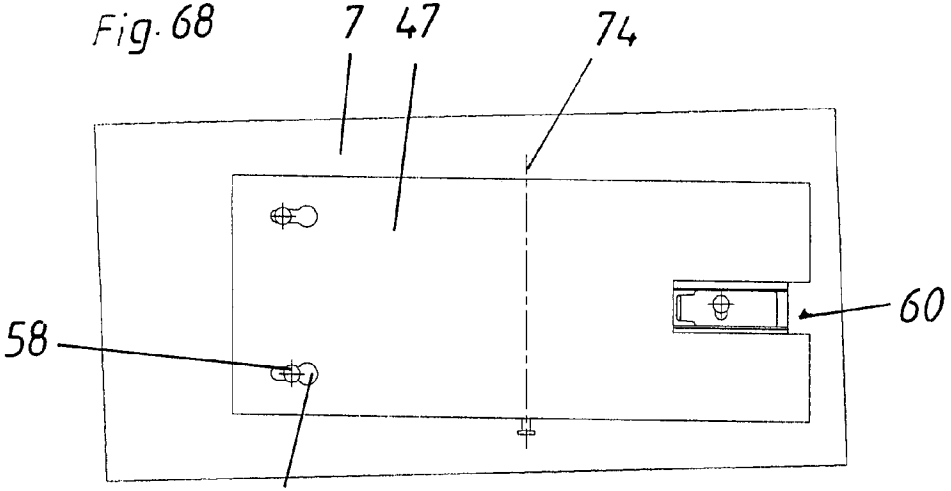
Figure 69:
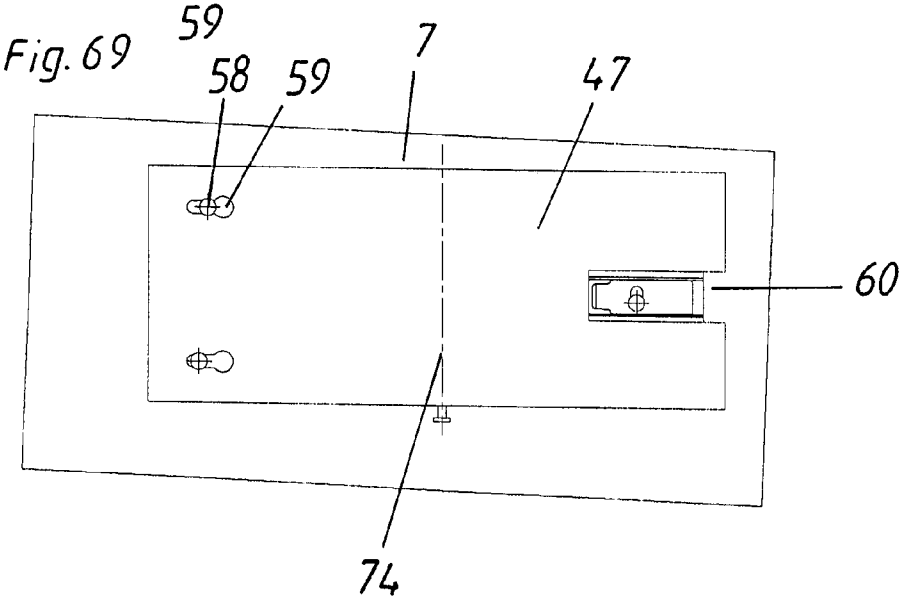

If the screw 73 is released, the part 61" can be shifted relative to the part 61' in the direction of the height of the front panel 4. This leads to a tilting of the plate 7 in relation to the vertical axis 74 in FIGS. 66 and 68. This tilting is effected in the plane of the plate 7.

The way of anchoring of the retaining arm 62 to the mounting plate 61 is described in EP 0 866 586 B 1 by the Applicant. This Patent Specification describes a hinge with a hinge arm and a hinge pot. In the present embodiment only the jointed levers and the hinge pot of the hinge are left out.

FIGS. 63 to 69 show the different adjustment possibilities for the plates 7', 7" at the retaining parts 47.

The invention claimed is:

1. A drawer for a corner cabinet, comprising:

a drawer base;

two drawer side walls mounted to said drawer base;

a rear wall mounted to said drawer base; and a front panel mounted to said drawer base, said front panel including at least two plates, each of said plates having an outer edge and an inner edge, said at least two plates being angled inward and rearwardly from said outer edges to said inner edges, wherein said at least two plates are arranged so as to be movable relative to said side walls upon application of a pulling force to said front panel in a direction away from said rear wall, and so as to be movable relative to said side walls upon application of a pushing force to said front panel in a direction toward said rear wall.

2. The drawer according to claim 1, wherein said at least two plates are arranged so as to be movable relative to each other upon application of the pulling force.

3. The drawer according to claim 1, wherein said at least two plates are arranged such that, upon application of the pulling force, said outer edges of said at least two plates move toward each other in a direction that has a directional component which is transverse to the direction of the pulling force.

4. The drawer according to claim 1, wherein the drawer is arranged to be withdrawn from a corner cabinet by the pulling force and inserted into the corner cabinet by the pushing force, and wherein said at least two plates are arranged such that, upon application of the pulling force, said at least two plates move relative to said side walls before the drawer is withdrawn from the corner cabinet.

5. The drawer according to claim 1, further comprising:

an interlocking device;

wherein the drawer is arranged to be withdrawn from a corner cabinet by the pulling force and inserted into the corner cabinet by the pushing force; and wherein the interlocking device is arranged to lock the drawer in the corner cabinet while said at least two plates are moved relative to said side walls.

6. The drawer according to claim 1, wherein:

said at least two plates are arranged such that, upon application of the pulling force, said at least one of said at least two plates is moved from an initial position to an open position; and a force accumulator is coupled to at least one of said at least two plates in such a manner as to return said at least one of said at least two plates to the initial position.

7. The drawer according to claim 6, wherein said force accumulator comprises a spring.

8. The drawer according to claim 1, wherein said at least two plates are pivotally mounted to said front panel.

9. The drawer according to claim 1, wherein at least one of said at least two plates is pivotally mounted to said front panel, and another of said at least two plates is mounted in a plane of said front panel so as to be linearly displaceable within the plane.

10. The drawer according to claim 1, wherein at least one of said at least two plates is mounted in a first plane of said front panel so as to be displaceable in a direction perpendicular to the first plane, and another of said at least two plates is mounted in a second plane of said front panel so as to be linearly displaceable within the second plane.

11. The drawer according to claim 1, wherein said at least two plates are moveably coupled to each other by a drawing cable.

12. The drawer according to claim 11, further comprising:

at least one pin projecting from at least one of said at least two plates in a direction toward said rear wall, wherein said drawing cable is secured to said at least one pin.

13. The drawer according to claim 1, wherein said at least two plates are moveably coupled to each other by toothed wheels or toothed wheel sections.

14. The drawer according to claim 1, wherein said at least two plates are coupled to at least one pusher element which is displaceable in the direction of the pushing force and the direction of the pulling force.

15. The drawer according to claim 14, wherein said at least one pusher element comprises:

a cylinder; and a piston rod which is linearly displaceable in said cylinder.

16. The drawer according to claim 1, wherein one of said at least two plates is mounted in a plane of said front panel and is coupled to at least two parallel pusher elements so as to be displaceable relative to the plane in a direction perpendicular to the plane.

17. The drawer according to claim 1, wherein the drawer is arranged to be withdrawn from a corner cabinet by the pulling force and inserted into the corner cabinet by the pushing force, and wherein said at least two plates are arranged to be locked in a position while the drawer is being withdrawn from or inserted into the corner cabinet.

18. The drawer according to claim 1, further comprising:

a closure wall mounted to said drawer base behind said at least two plates.

19. The drawer according to claim 1, further comprising:

a middle post arranged between said at least two plates.

20. The drawer according to claim 1, wherein said front panel further includes:

a carrier part mounted to said drawer base; and at least two retaining parts movably coupled to said carrier part, wherein said at least two plates are mounted on said at least two retaining parts, respectively.

21. The drawer according to claim 1, wherein said front panel further includes:

at least two retaining parts movably mounted to said drawer base, said at least two plates being mounted on said at least two retaining parts, respectively; and a control part to be secured to a body of furniture, said control part having at least two guide tracks, wherein said at least two retaining parts and said at least two guide tracks are arranged such that an end of each of said at least two retaining parts is guided by a respective one of said at least two guide tracks as said at least two plates are moved relative to said side walls.

22. A drawer for a corner cabinet, comprising:

a drawer base;

two drawer side walls mounted to said drawer base;

a rear wall mounted to said drawer base; and a front panel mounted to said drawer base, said front panel having at least two plates, each of said plates having an outer edge and an inner edge, said at least two plates being angled inward and rearwardly from said outer edges to said inner edges, wherein said at least two plates are arranged so as to be movable relative to said side walls in such a manner that at least one of said at least two plates is pivotable relative to another of said at least two plates such that said at least one of said at least two plates pivots towards said another of said at least two plates upon application of a pulling force to said front panel in a direction away from said rear wall, and away from said another of said at least two plates upon application of a pushing force to said front panel in a direction toward said rear wall.

23. The drawer according to claim 22, wherein the drawer is arranged to be withdrawn from a corner cabinet by the pulling force and inserted into the corner cabinet by the pushing force, and wherein said at least two plates are arranged such that, upon application of the pulling force, said at least two plates move relative to said side walls before the drawer is withdrawn from the corner cabinet.

24. The drawer according to claim 22, further comprising:

an interlocking device;

wherein the drawer is arranged to be withdrawn from a corner cabinet by the pulling force and inserted into the corner cabinet by the pushing force; and wherein the interlocking device is arranged to lock the drawer in the corner cabinet while said at least two plates are moved relative to said side walls.

25. The drawer according to claim 22, wherein:

said at least two plates are arranged such that, upon application of the pulling force, said at least one of said at least two plates is moved from an initial position to an open position; and a force accumulator is coupled to at least one of said at least two plates in such a manner as to return said at least one of said at least two plates to the initial position.

26. The drawer according to claim 25, wherein said force accumulator comprises a spring.

27. The drawer according to claim 22, wherein at least one of said at least two plates is mounted in a plane of said front panel so as to be linearly displaceable within the plane.

28. The drawer according to claim 22, wherein at least one of said at least two plates is mounted in a first plane of said front panel so as to be displaceable in a direction perpendicular to the first plane, and another of said at least two plates is mounted in a second plane of said front panel so as to be linearly displaceable within the second plane.

29. The drawer according to claim 22, wherein said at least two plates are moveably coupled to each other by a drawing cable.

30. The drawer according to claim 29, further comprising:

at least one pin projecting from at least one of said at least two plates in a direction toward said rear wall, wherein said drawing cable is secured to said at least one pin.

31. The drawer according to claim 22, wherein said at least two plates are moveably coupled to each other by toothed wheels or toothed wheel sections.

32. The drawer according to claim 22, wherein said at least two plates are coupled to at least one pusher element which is displaceable in the direction of the pushing force and the direction of the pulling force.

33. The drawer according to claim 32, wherein said at least one pusher element comprises:

a cylinder; and a piston rod which is linearly displaceable in said cylinder.

34. The drawer according to claim 22, wherein one of said at least two plates is mounted in a plane of said front panel and is coupled to at least two parallel pusher elements so as to be displaceable relative to the plane in a direction perpendicular to the plane.

35. The drawer according to claim 22, wherein the drawer is arranged to be withdrawn from a corner cabinet by the pulling force and inserted into the corner cabinet by the pushing force, and wherein said at least two plates are arranged to be locked in a position while the drawer is being withdrawn from or inserted into the corner cabinet.

36. The drawer according to claim 22, further comprising:

a closure wall mounted to said drawer base behind said at least two plates.

37. The drawer according to claim 22, further comprising:

a middle post arranged between said at least two plates.

38. The drawer according to claim 22, wherein said front panel further includes:

a carrier part mounted to said drawer base; and at least two retaining parts movably coupled to said carrier part, wherein said at least two plates are mounted on said at least two retaining parts, respectively.

39. The drawer according to claim 22, wherein said front panel further includes:

at least two retaining parts movably mounted to said drawer base, said at least two plates being mounted on said at least two retaining parts, respectively; and a control part to be secured to a body of furniture, said control part having at least two guide tracks, wherein said at least two retaining parts and said at least two guide tracks are arranged such that an end of each of said at least two retaining parts is guided by a respective one of said at least two guide tracks as said at least two plates are moved relative to said side walls.

* * * * *